US005383734A

United States Patent [19]

Uchikata et al.

[11] Patent Number: 5,383,734

[45] Date of Patent: Jan. 24, 1995

[54] IMAGE RECORDING APPARATUS HAVING A RIBBON DRIVE SLIP CLUTCH

[75] Inventors: Yoshio Uchikata; Toshiyuki Ohnishi, both of Yokohama, Japan

[73] Assignee: Canon Kabushiki Kaisha, Tokyo, Japan

[21] Appl. No.: 203,614

[22] Filed: Feb. 28, 1994

Related U.S. Application Data

[63] Continuation of Ser. No. 104,593, Aug. 10, 1993, abandoned, which is a continuation of Ser. No. 13,546, Feb. 4, 1993, abandoned, which is a continuation of Ser. No. 507,111, Apr. 10, 1990, abandoned.

[30] Foreign Application Priority Data

| | | | |
|---|---|---|---|
| Apr. 10, 1989 | [JP] | Japan | 1-090076 |
| Apr. 10, 1989 | [JP] | Japan | 1-090077 |
| May 31, 1989 | [JP] | Japan | 1-136165 |

[51] Int. Cl.[6] ..... B41J 3/36

[52] U.S. Cl. ..... 400/227.2; 400/222; 400/236.2

[58] Field of Search ..... 400/120, 225, 232, 224.2, 400/230, 231, 218, 221, 221.1, 222.2, 222, 236.2, 227.2

[56] References Cited

U.S. PATENT DOCUMENTS

| | | | |
|---|---|---|---|
| 4,231,667 | 11/1980 | Behrendt et al. | 400/232 |
| 4,353,658 | 10/1982 | Craft | 400/232 |
| 4,496,955 | 1/1985 | Maeyama et al. | 346/76 PH |
| 4,573,059 | 2/1986 | Shinma et al. | 346/76 PH |
| 4,591,876 | 5/1986 | Nozaki et al. | 346/76 PH |
| 4,639,744 | 1/1987 | Uchikata et al. | 346/76 PH |
| 4,641,150 | 2/1987 | Matsuura et al. | 400/229 |
| 4,672,393 | 6/1987 | Uchikata et al. | 346/76 PH |
| 4,694,305 | 9/1987 | Shiomi et al. | 347/76 PH |
| 4,762,434 | 8/1988 | Hirano | 400/232 |
| 4,887,096 | 12/1989 | Asakura et al. | 346/76 PH |
| 4,955,738 | 9/1990 | Uchikata et al. | 400/229 |
| 5,096,315 | 3/1992 | Yamamoto et al. | 400/236.2 |

FOREIGN PATENT DOCUMENTS

| | | | |
|---|---|---|---|
| 0102474 | 3/1984 | European Pat. Off. . | |
| 0160967 | 11/1985 | European Pat. Off. . | |
| 0180911 | 5/1986 | European Pat. Off. . | |
| 3610559 | 11/1986 | Germany . | |
| 0140269 | 8/1983 | Japan | 400/232 |
| 0021289 | 2/1985 | Japan | 400/232 |
| 60-23091 | 2/1985 | Japan . | |
| 0064878 | 4/1985 | Japan | 400/120 MP |
| 60-242090 | 12/1985 | Japan . | |
| 0177273 | 8/1986 | Japan | 400/232 |
| 0277479 | 12/1986 | Japan | 400/232 |
| 0246272 | 10/1988 | Japan | 400/232 |
| 0316286 | 12/1989 | Japan | 400/232 |
| 0215577 | 8/1990 | Japan | 400/232 |

OTHER PUBLICATIONS

IBM Technical Disclosure Bulletin, vol. 21, No. 6, Nov. 1978 Ribbon Clutch with Temperature-Sensitive Output.

*Primary Examiner*—David A. Wiecking
*Assistant Examiner*—John S. Hilten
*Attorney, Agent, or Firm*—Fitzpatrick, Cella, Harper & Scinto

[57] ABSTRACT

An image recording apparatus for performing image recording on a recording medium by using an ink sheet having a plurality of colors of ink includes a recording head acting on the ink sheet to perform image recording on the recording medium, a first feeding unit for feeding the ink sheet through a clutch, a second feeding unit for feeding the ink sheet without going through the clutch, and a unit for selectively switching between the first feeding unit and the second feeding unit.

11 Claims, 29 Drawing Sheets

FIG. 20

TEXT

IT IS (A) FINE (A) TODAY. PAGE RENEWAL

IT WILL (B) RAIN (B) TOMORROW. PAGE RENEWAL

IT WILL BE (C) CLOUDY (C) AND (B) THEN (B) RAINY. PAGE RENEWAL

FIG. 21A

PRINTING MENUE

| | | | |
|---|---|---|---|
| COLOR DESIGNATION | CASSETTE | UPPER STAGE | BLACK |
| | | LOWER STAGE | A·B·C |

FIG. 21B

PRINTING MENUE

| | | | |
|---|---|---|---|
| COLOR DESIGNATION | CASSETTE | UPPER STAGE | BLACK |
| | | LOWER STAGE | A |

| |
|---|
| FIG. 22A-1 |
| FIG. 22A-2 |

| |
|---|
| FIG. 33A |
| FIG. 33B |

IMAGE RECORDING APPARATUS HAVING A RIBBON DRIVE SLIP CLUTCH

This application is a continuation of application Ser. No. 08/104,593 filed Aug. 10, 1993, now abandoned, which is a continuation of application Ser. No. 08/013,546 filed Feb. 4, 1993, abandoned, which is a continuation of application Ser. No. 07/507,111 filed Apr. 10, 1990, abandoned.

BACKGROUND OF THE INVENTION

1. Filed of the Invention

The present invention relates to an image recording apparatus for recording an image on a recording medium by using an ink sheet having a plurality of colors of ink, and a method of recording the image. More particularly, the present invention relates to an image recording apparatus and a method thereof, capable of obtaining a multi-color image recording output in accordance with image information or the like. The image recording apparatuses and forms of their methods can be appropriately applied to a computer, CAD, a workstation, a wordprocessor, a personal computer, a facsimile machine, an electronic typewriter, a copying machine, and a printer.

2. Related Background Art

In a conventional image recording apparatus using an ink sheet (parallel-striped coating ink sheet) of repeated stripe-like ink components of a plurality of colors (inks) formed on an ink sheet in a direction perpendicular to an ink sheet feed direction, it is desirable to feed (wind) the ink sheet at almost a constant velocity during image recording. For this purpose, a recording head in a recording unit is generally brought into tight contact with a platen or the like through an ink sheet to perform main ink sheet feed and to remove slackening of the ink sheet through a clutch.

At the time of a change in color of the ink sheet, the ink sheet must be fed independently of a recording sheet. For this purpose, the recording head in the recording unit is generally released from the platen, and the ink sheet is fed by a winding means through a clutch.

The ink sheet generally has a form of a roll and is generally supplied from a supply roll to a winding or take-up roll. In this case, a back tension is applied to the supply roll to prevent unnecessary slackening or the like.

A winding force during a change in color of the ink sheet must exceed a sum of the back tension, a load of the supply roll, and the load of the ink sheet feed path. A large winding force may cause variations in feed precision and contamination of a recorded image (printed image) because such a force adversely affects main feeding during image recording. The winding force using the clutch must fall within a predetermined range and is also influenced by the back tension of the supply roll, and the like.

In order to solve the above problem, a means for bringing a roller or the like into rolling contact with an ink sheet to feed the ink sheet to a location except for a recording unit may be arranged to cause a winding means to wind the ink sheet through a clutch arranged on the roll shaft. However, this arrangement has a complicated structure.

A conventional recording apparatus of this type is arranged to cause a color sensor to detect each bar code of a multi-color ink ribbon. The multi-color ink ribbon is wound while a recording head is kept in a DOWN (i.e., the recording head is kept in contact with the platen through the ink ribbon) state (the ink ribbon is pulled), and the ribbon is fed at a constant velocity (i.e., the ribbon passes by the color sensor) to detect the bar code.

In the conventional arrangement, since the velocity of the ink sheet which passes by the color sensor is kept constant, the recording head is set in the DOWN state and the ink ribbon is wound at the constant velocity, although the ribbon can be wound at a high velocity depending on a winding radius. In order to perform a high-speed winding operation, it is possible to wind the ribbon while the recording head is kept in an UP state. In order to perform direct winding, a traveling velocity of the multi-color ink ribbon is changed from the start of ribbon winding to the end of ribbon winding, and ON and OFF timings (cycles) of the bar codes are not constant, and the colors cannot be detected by the color sensor, undesirably resulting in an operation error.

It is possible to increase a bar code width to eliminate a detection error of the color sensor. In this case, however, a maximum recording range is narrowed.

SUMMARY OF THE INVENTION

It is an object of the present invention to provide an image recording apparatus and a method thereof, capable of recording a high-quality image.

It is another object of the present invention to provide an image recording apparatus and a method thereof, capable of accurately changing a color of an ink sheet.

It is still another object of the present invention to provide an image recording apparatus and a method thereof, capable of changing a color of an ink sheet at a high velocity.

It is still another object of the present invention to provide an image recording apparatus and a method thereof, capable of eliminating the conventional problems described above, recording a high-quality image, and accurately changing a color of an ink sheet.

It is still another object of the present invention to provide an image recording apparatus and a method thereof, capable of eliminating the conventional problems described above, bar code detection errors, and color detection errors for a multi-color ink sheet.

BRIEF DESCRIPTION OF THE DRAWINGS

FIG. 20 is a view for explaining color designation in a text;

FIGS. 21A and 21B are views for explaining color designation in a printing menu;

FIGS. 22A-1, 22A-2 and 22B are flow charts showing a recording (printing) sequence in the recording apparatus of the present invention;

DETAILED DESCRIPTION OF THE PREFERRED EMBODIMENTS

The first embodiment according to the present invention will be described below.

The first embodiment to be described below comprises a first feeding means for conveying or feeding an ink sheet through a clutch, a second feeding means for feeding the ink sheet without slippage, and a means for selectively switching the first feeding means and the second feeding means.

According to this embodiment, high-quality image recording and an accurate change in color of the ink sheet can be performed by a simple structure.

The first embodiment of the present invention will be described in detail with reference to the accompanying drawings.

According to the first embodiment, in a thermal printer using a parallel-striped coating ink sheet, the ink ribbon is wound through a clutch during recording. During a change in color, a recording head is set in an UP state, and the ink sheet is wound without slippage. Therefore, the thermal printer can perform a stable change in color of the ink ribbon at a high velocity and can eliminate idle time during recording and prevent pitch errors.

Figure 1:
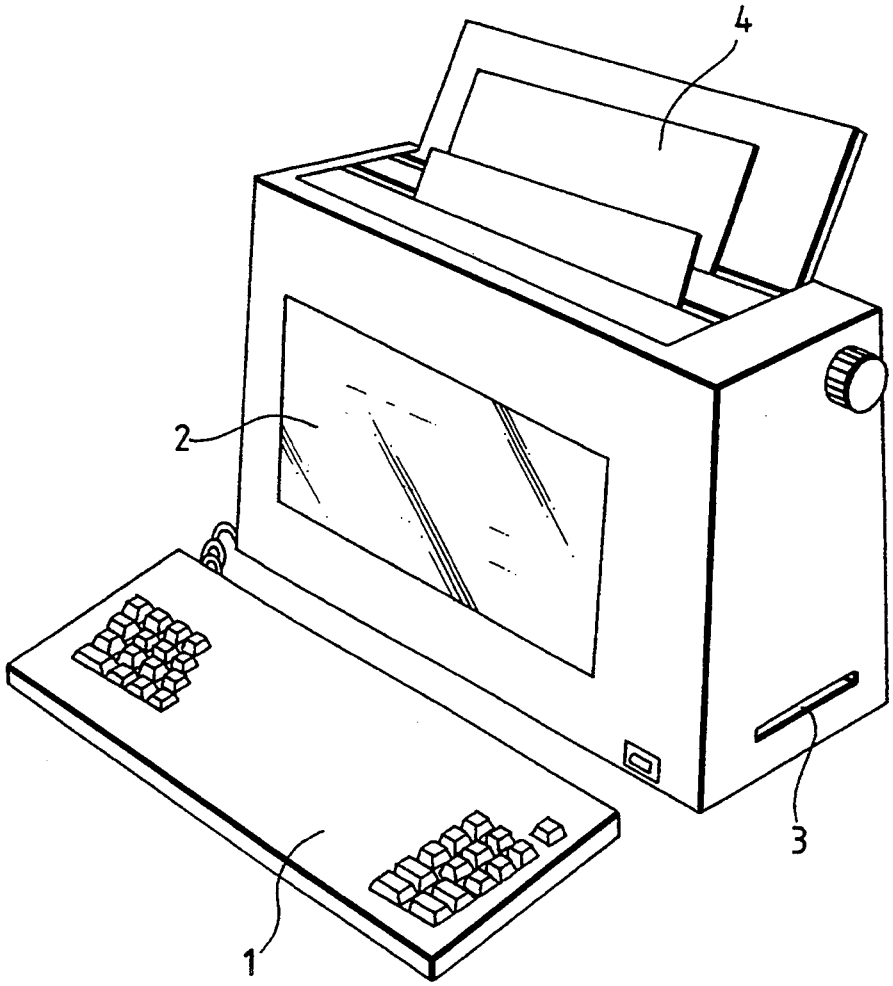
FIG. 1 is a perspective view showing an outer appearance of a wordprocessor having a recording apparatus according an embodiment of the present invention.

FIG. 1 is a perspective view showing an outer appearance of a wordprocessor according to the first embodiment of the present invention.

Referring to FIG. 1, the wordprocessor includes a keyboard 1 serving as an input operation unit which includes a color key (to be described later) and function keys. The wordprocessor also includes a CRT (or LCD) 2 serving as a display unit, and a floppy disk 3 serving as a memory unit. A recording sheet (e.g., normal paper, processed paper, or an OHP sheet) serves as a recording medium.

Figure 2:
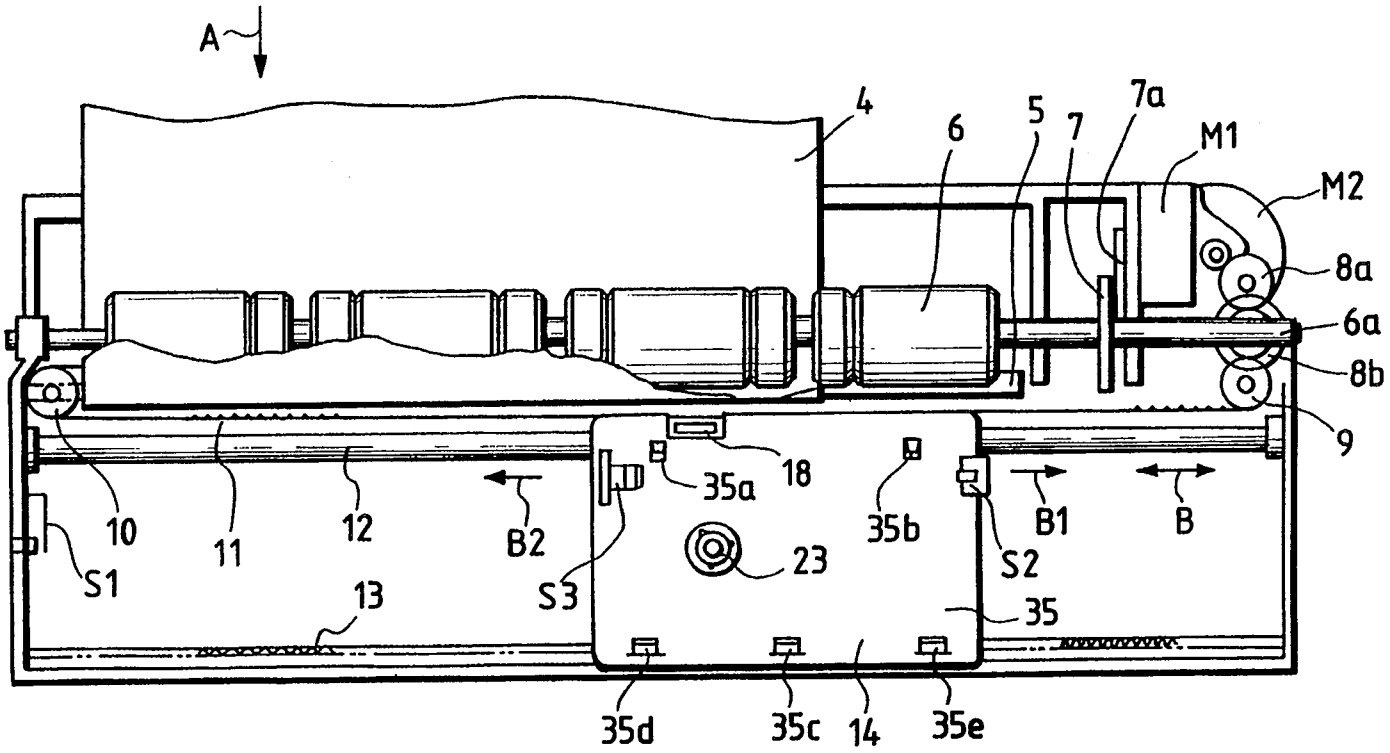
FIG. 2 is a plan view of the recording apparatus according to the present invention.

FIG. 2 shows a recording unit of a recording apparatus according to the first-embodiment of the present invention.

Referring to FIG. 2, a recording sheet 4 is urged against a rubber portion of a sheet feed roller 6 by a pinch roller 6*b* (FIG. 3) while the recording sheet 4 is backed up on a platen 5. A gear 7 is mounted on a shaft 6*a* of the sheet feed roller 6, and the shaft 6*a* is connected to a sheet feed motor M1 through a reduction gear 7*a*. Upon rotation of the sheet feed motor M1, the sheet feed roller 6 is rotated to feed the recording sheet 4.

When a thermal head 18 (to be described in detail later) is brought into contact with the recording sheet 4 to perform image recording, the platen 5 maintains the position of the recording sheet 4.

Reciprocal movement of a carriage 14 will be described below.

A shaft 12 is fixed in front of the platen 5, and a rack 13 is fixed at a position opposite to the carriage 14. The carriage 14 (FIGS. 3 and 4) is guided and supported to be movable by the shaft 12 and a guide surface constituted by the upper surface of the rack 13 in directions indicated by a double-headed arrow B. That is, the carriage 14 can be reciprocated in a direction perpendicular to a feed path A of the recording sheet 4. Part of a belt 11 is fixed to the carriage 14, and the belt 11 is kept taut by a pulley gear 9 and a pulley 10. The pulley gear 9 is connected to a carriage motor M2 through reduction gears 8*a* and 8*b*. The pulley gear and the pulley are rotated upon rotation of the carriage motor M2 and the belt 11 is driven. Therefore, the carriage 14 is reciprocated (directions of the double-headed arrow B) along the shaft 12.

A head holder 19 (FIG. 4) is guided and supported by the carriage 14 to be rotatable about a head holder shaft 19*b*. The thermal head 18 is mounted on the head holder 19, and the head holder 19 also serves as a heat sink.

A carriage table 35 is mounted on the carriage 14 to stack two ink sheet cassettes (ink ribbon cassettes) 40 (FIGS. 5 and 13) horizontally. A color detecting means (color sensor) S3 for discriminating colors of a multicolor ribbon 50 (FIG. 15) is arranged on the carriage table 35. A ribbon sensor S2 (FIG. 2) for detecting the presence/absence and the type of the ink ribbon cassette 40 and an end of an ink ribbon 49 is arranged on the carriage 14.

An operation for loading/unloading the ink ribbon cassettes 40 in/from the carriage table 35 will be described below.

It is possible to stack the ink ribbon cassettes 40 on the carriage table 35 horizontally. Pins 35*a* and 35*b* and hooks 35*c*, 35*d*, and 35*e* are formed on the upper surface of the carriage table 35.

When the ink ribbon cassette 40 is loaded in the lower position, the pins 35*a* and 35*b* are inserted into openings 41*a* and 41*b*, and openings 42*i* and 42*j* formed in the upper and lower cases of the ink ribbon cassette 40 (FIGS. 13 and 14) to be described in detail later. The hook 35*c* is elastically engaged with a lock portion 42*k* of the lower case, and the ink ribbon cassette 40 is detachably loaded on the carriage table 35. A similar operation is performed to load the ink ribbon cassette 40 to the upper position. The pins 35*a* and 35*b* are inserted into the openings 41*a* and 41*b* and the openings 42*i* and 42*j*, and the hooks 35*d* and 35*e* are elastically engaged with engaging portions 42*i* and 42*m* of the lower case, thereby loading the upper ink ribbon cassette 40 on the carriage table 35 through the lower ink ribbon cassette 40.

A plurality (two stages) of ink sheet (including the ink ribbon) loading sections are formed.

The structure on the carriage 14 will be described below.

Figure 4:
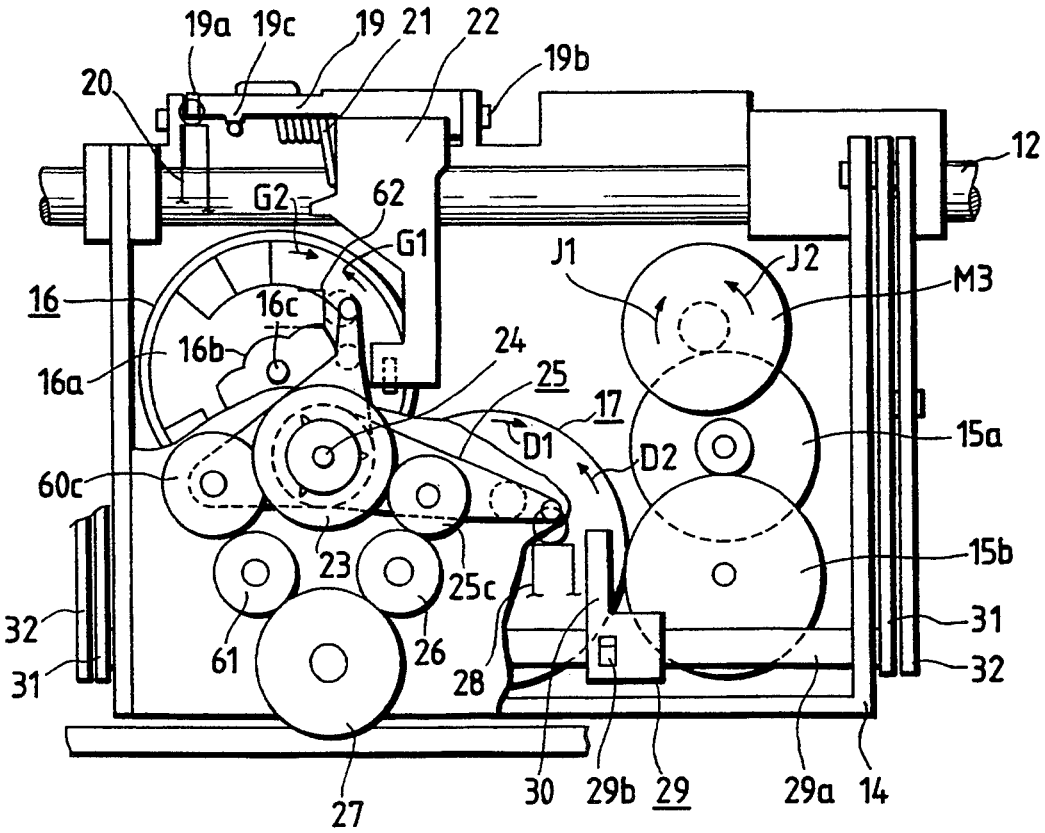
FIG. 4 is a partially cutaway plan view showing an overall structure of a carriage of the recording apparatus according to the present invention.

FIG. 4 is a view showing the overall structure of the carriage 14.

Referring to FIG. 4, a head motor M3 is mounted on the carriage 14, and a driving force of the head motor M3 is transmitted through reduction gears 15*a* and 15*b* to rotate a head cam 16 and a ribbon cam 17.

Figure 6:
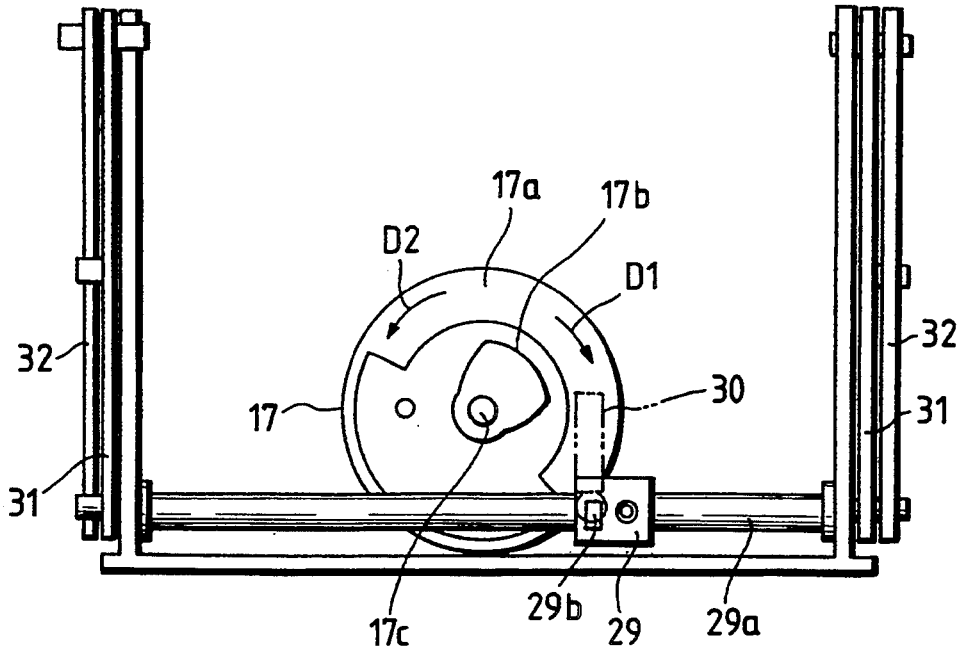
FIG. 6 is a plan view showing a cassette UP/DOWN mechanism in FIG. 4.

The head cam 16 is used to perform a head UP/-DOWN operation (separation of the recording head 18 from the platen 5 and contact between them) and as direct winding ON/OFF operation. A cam surface 16*a* is formed on the upper surface of the head cam 16 to change the height of the head cam 16 along the axial direction of a rotating shaft 16*c*. A ribbon direct winding cam surface 16*b* is formed on the upper surface to change its radius centered on the rotating shaft 16*c* in a direction perpendicular to the rotating shaft 16*c* of the head cam 16. The ribbon cam 17 is a cam for performing an ON/OFF operation for ribbon clutch winding (to be described later) and an UP/DOWN operation of the cassette. A cassette UP/DOWN cam surface 17*a* is formed on the upper surface of the ribbon cam 17 so that the height of the cam surface 17*a* is changed in the axial direction of a rotating shaft 17*c* of the ribbon cam 17, as shown in FIG. 6. A ribbon clutch winding cam surface 17*b* is formed on the upper surface so that the radius of the cam surface 17*b* is changed centered on the rotating shaft 17*c* along a direction perpendicular to the axial direction of the rotating shaft 17*c* of the ribbon cam 17.

Figure 7:
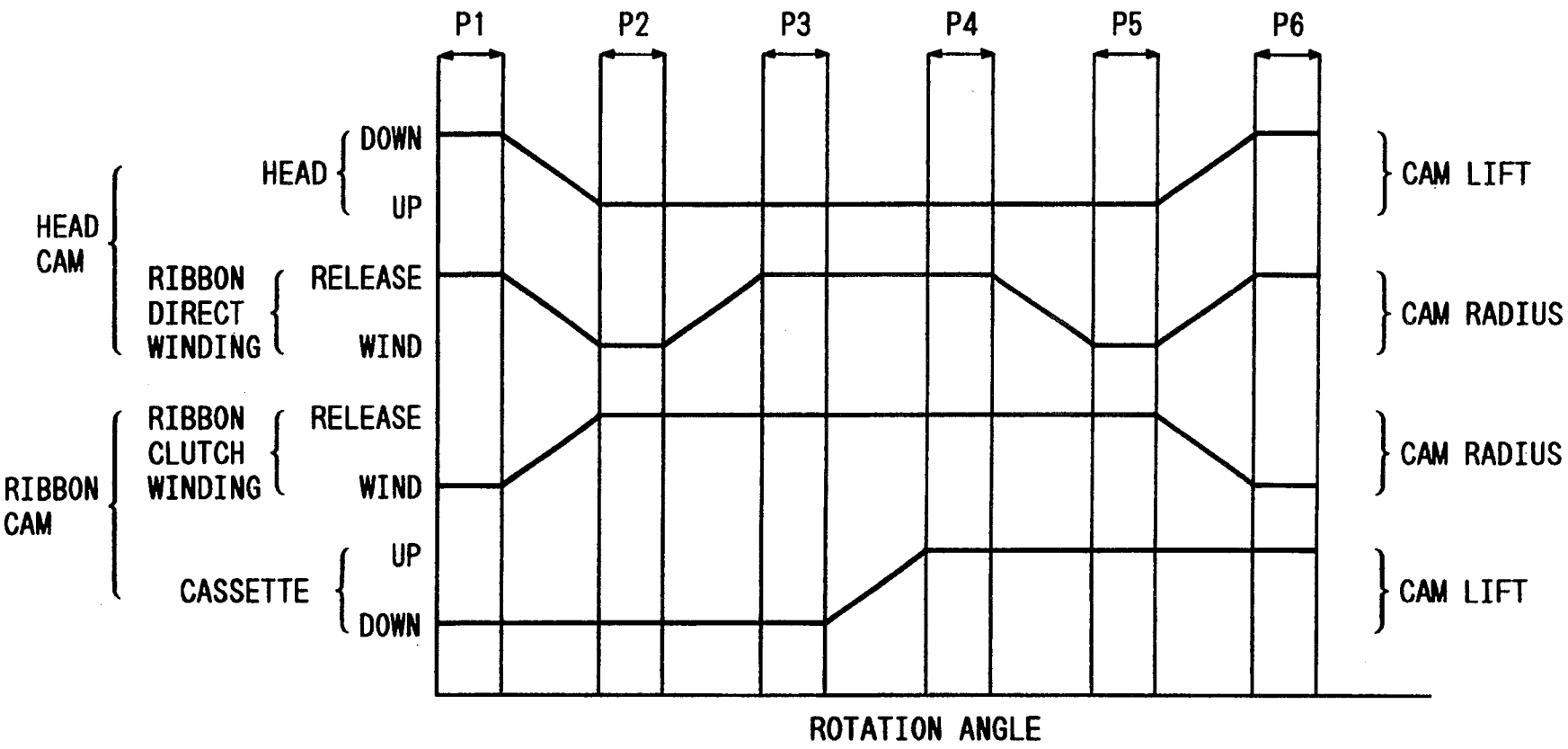
FIG. 7 is a chart showing cam movement in the carriage shown in FIG. 4.

A cam chart of the head cam 16 and the ribbon cam 17 is shown in FIG. 7.

Referring to FIG. 7, the head UP and DOWN operations, the ribbon direction winding operation, the ribbon clutch winding operation, and the cassette UP and DOWN operations are performed in accordance with positions of the head cam 16 and the ribbon cam 17 which are rotated upon driving of the head motor M3 (FIG. 4).

Rotation of the head cam 16 and the ribbon cam 17 is regulated within the range of the cam chart of FIG. 7 by stoppers (not shown) formed on the carriage 14.

Referring to FIG. 7, when the cam surface 16*a* of the head UP/DOWN cam surface 16 is located at a low position (P2 to P5), the head UP state (separation) to be described later is set. However, when the cam surface 16*a* is set at a high position (P1 and P6), a head DOWN state (urging or contact) to be described later is set.

When the radius of the ribbon direct winding cam surface 16*b* of the head cam 16 is small (P2 and P5), the ribbon direct winding (to be described in detail later) is set. However, when the radius of the cam surface is large (P1, P3, P4, and P6), a ribbon direct winding release state (to be described in detail later) is set.

When the ribbon clutch winding cam surface 17*b* of the ribbon cam 17 has a small radius (P1 and P6), a ribbon clutch winding enable state (to be described later) is set. However, when the radius of the cam surface is large (P2 to P5), a ribbon clutch winding release state (to be described later) can be set.

When the cassette UP/DOWN cam surface 17*a* of the ribbon cam 17 is set at a low position (P1 to P3), a cassette DOWN state (to be described later) is set. However, when the cam surface is set at a high position (P4 to P6), a cassette UP state (the lower cassette is used) is set.

The cassette UP/DOWN mechanism (ink sheet switching means) will be described below.

Figure 3:
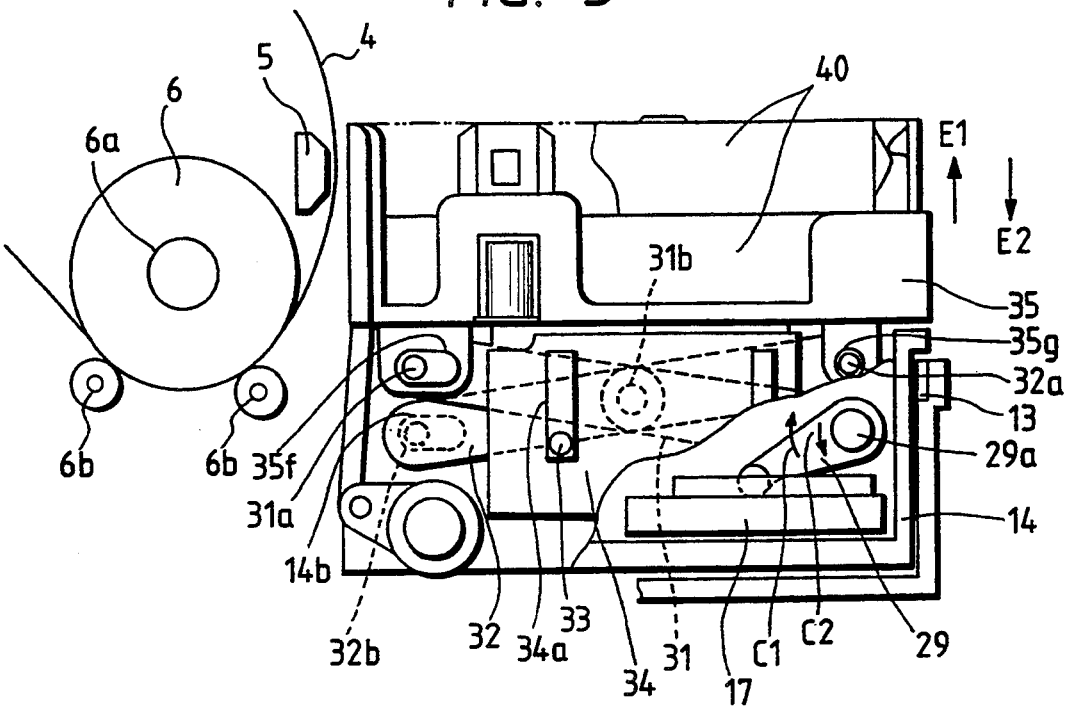
FIG. 3 is a side view showing a cassette DOWN state shown in FIG. 6.
Figure 5:
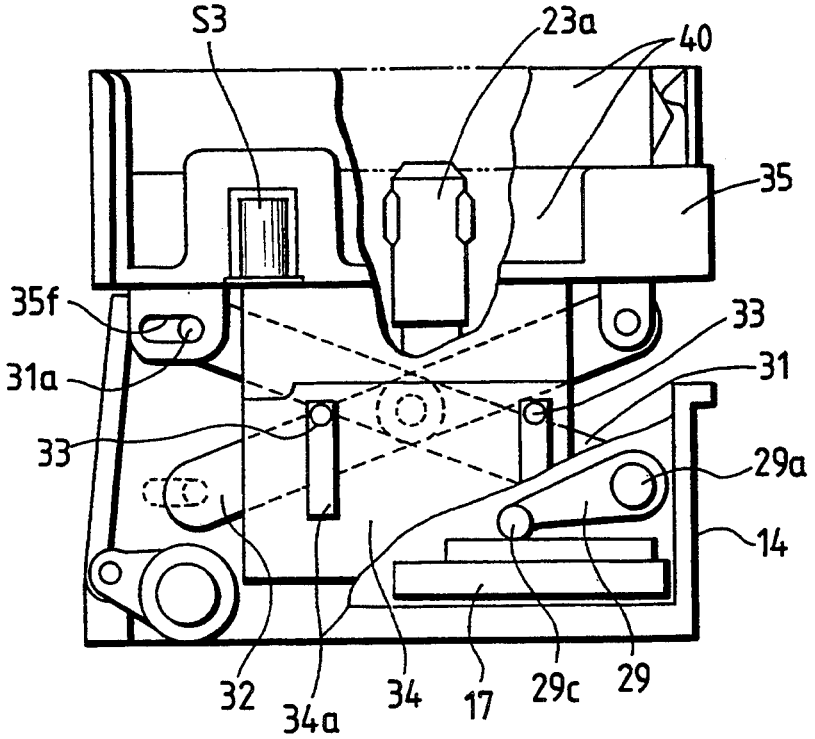
FIG. 5 is a side view showing a cassette UP state shown in FIG. 6.

FIG. 6 is a plan view of the cassette UP/DOWN mechanism, FIG. 3 is a side view showing the cassette DOWN state, and FIG. 5 is a side view showing a cassette UP state.

Referring to FIGS. 3, 5, and 6, a cassette shift lever A29 is fixed to a cassette shift shaft 29*a* rotatably guided and supported on the carriage 14*a*. A cassette shift spring 30 is mounted between a projection portion 29*b* of the cassette shift lever A29 and a projection portion (not shown) of the carriage 14.

A distal end portion 29*c* of the cassette shift lever A29 is biased in a direction of an arrow C2 by a spring force of the cassette shift spring 30. Therefore, the distal end portion 29*c* abuts against the cam surface 17*a* of the ribbon cam 17 (FIG. 3).

The cassette shaft 29*a* of the cassette shift lever A29 is connected to a cassette shift lever B31 through the shift shaft 29*a*. A cassette shift lever C32 is rotatably supported by a boss 31*b* formed on the cassette shift lever B31.

A boss 31*a* is fixed at one end of the cassette shift lever B31, and a boss 32*a* is fixed at the distal end of the cassette shift lever C32. The bosses 31*a* and 32*a* are inserted in openings 35*f* and 35*g* of the carriage table 35. A boss 32*b* is formed at the other distal end of the cassette shift lever C32, and the boss 32*b* is inserted into the opening 14*b* of the carriage 14. Therefore, the carriage 35 is supported to be almost horizontal.

When the cam surface 17*a* is moved upward and the cam shift lever A29 is rotated clockwise (i.e., a direction of an arrow C1). (FIG. 3), the cassette shift lever B31 is also rotated clockwise (i.e., the direction of the arrow C1) (FIG. 3).

As described above, heights of the center of rotation of the cassette shift lever B31, i.e., the cassette shift shaft 29*a*, and the boss 32*b* of the cassette shift lever C32 are regulated by the carriage 14. When the boss 31*a* of the cassette shift lever B31 moves the opening 35*f* of the carriage table, and the boss 32*b* of the cassette shift lever C32 moves the opening 14*b* of the carriage 14. That is, the carriage table 35 is moved vertically (directions of arrows E1 and E2) (FIG. 3) by converting rotation motion into linear motion by a pantographic mechanism.

A boss 33 is formed on the carriage table 35 and is inserted into an opening 34*a* formed in a carriage cover 34 mounted on the carriage 14, so that vertical movement (the directions of the arrows E1 and E2) (FIG. 3) of the carriage table 35 is regulated within the range. That is, an UP or DOWN position of the carriage table 35 is accurately determined by the opening 34*a*.

A cassette UP/DOWN operation, i.e., an ink sheet (including the ink ribbon) switching operation in the above arrangement will be described below.

FIGS. 3 and 6 show a cassette DOWN (the upper cassette is used) state.

In this state, the ribbon cam 17 is set in a state during an interval of P1 to P3 in the chart of FIG. 7. The distal end portion 29*c* of the cassette shift lever A29 abuts against the lower cam surface 17*a* of the ribbon cam 17 by the biasing force of the cassette shift spring 30, and the carriage table 35 is set at the DOWN position.

When the ribbon cam 17 is rotated clockwise (i.e., a direction of an arrow D1) (FIG. 6) in this state, a contact point between the cam surface 17*a* of the ribbon cam 17 and the distal end portion 29*c* of the cassette shift lever A29 causes an increase in height of the cam surface in the vertical direction.

With this increase in height, the cassette shift lever A29 is rotated clockwise (the direction of the arrow C1) (FIG. 3) against the biasing force of the cassette shift spring 30.

As described above, upon rotation of the cassette shift lever A29, the carriage table 35 is moved in the UP direction (i.e., the direction of the arrow E1) (FIG. 3). When the height of the cam surface 17*a* reaches the position indicated by P4 to P6 (FIG. 7), the lower cassette use state (FIG. 5) is set.

The ink winding mechanism, i.e., the ink sheet feeding means will be described below.

Figure 8:
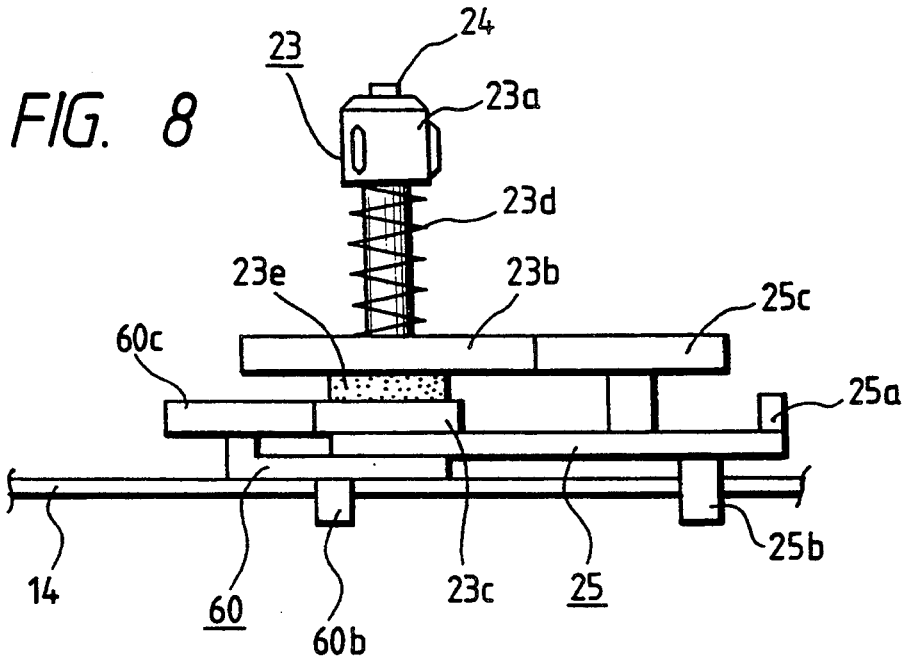
FIG. 8 is a side view of a ribbon winding mechanism shown in FIG. 4.
Figure 9A:
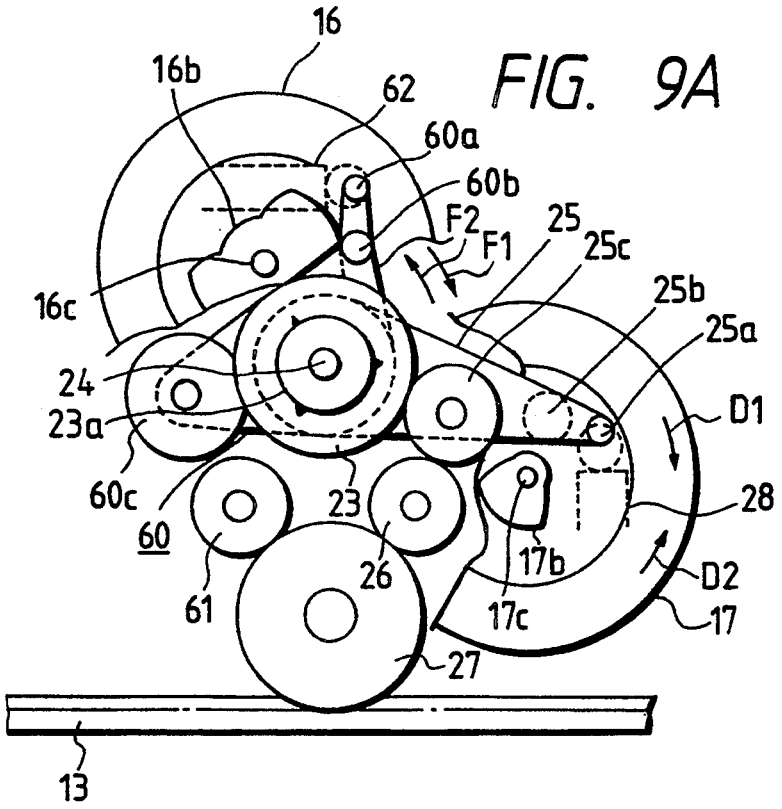
FIGS. 9A and 9B are plan views showing the ribbon winding mechanism.
Figure 9B:
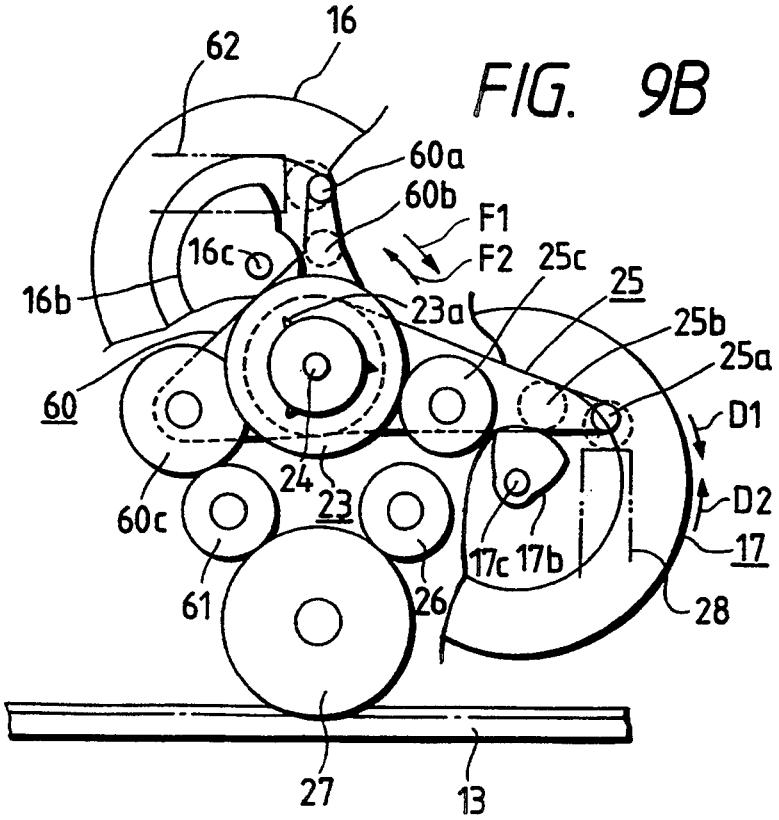

FIG. 8 is a side view of the ribbon winding mechanism, FIG. 9A is a plan view showing a ribbon clutch winding state and a ribbon direct winding release state, and FIG. 9B is a plan view showing a ribbon clutch winding release state and a ribbon direct winding state.

Referring to FIGS. 8, 9A, and 9B, a winding shaft 24 is mounted on the carriage 14, and a clutch winding lever 25 and a direct winding lever 60 are rotatably supported on the winding shaft 24. A winding clutch 23 is rotatably supported on the upper portions of the levers 25 and 60. A clutch drive gear 25*c* is rotatably supported on the clutch winding lever 25. A clutch gear portion 23*b* of the winding clutch 23 serves as a sun gear, and the clutch drive gear 25*c* serves as a planetary gear and meshes with the sun gear. A direct drive gear 60*c* is rotatably supported on the direct winding lever 60. A direct gear 23*c* of the winding clutch 23 serves as a sun gear, and the direct drive gear 60*c* serves as a planetary gear and meshes with the sun gear. A hub seat 23*a* is formed in the winding clutch 23, and a winding core 44 (FIGS. 13 and 14) in the ink ribbon cassette 40 is fitted in the hub seat 23*a*. The hub seat 23*a* is formed integrally with the direct gear portion 23*c* and is rotatably supported by the integral body. The clutch drive gear portion 23*b* is urged against a felt pad portion 23*e* adhered to the direct gear portion 23*c* through a clutch spring 23*d*. A contact surface of the clutch drive gear portion 23*b* which contacts the felt pad portion 23*e* is formed to have a higher frictional coefficient.

A rotation force input to the clutch drive gear 23*b* is transmitted to the hub seat 23*a* by the friction on the felt pad surface. That is, the force is transmitted by the frictional clutch. A rotation force input to the direct drive gear 60*c* is transmitted directly to the hub seat 23*a*. That is, direct transmission can be performed without any slippage. A winding intermediate gears R26 and R27 meshed with the winding gear 27 are rotatably guided to the carriage 14. The winding gear 27 is meshed with the rack 13 and is rotated upon movement of the carriage 14 in the B direction (FIG. 2). A clutch winding lever biasing spring 28 is arranged between a spring hook 25*a* of the clutch winding lever 25 and a spring hook (not shown) of the carriage 14 to bias the clutch winding lever 25 in a direction of an arrow F1 (FIG. 9A). A direct winding lever biasing spring 62 is arranged between a spring hook portion 60*a* of the direct winding lever 60 and a spring hook (not shown) of the carriage 14 to bias the direct winding lever 60 in a direction of an arrow F2 (FIG. 9A).

The ribbon winding operation, i.e., the operation of the ink sheet feeding means will be described below.

Ribbon clutch winding, i.e., an ink sheet feed operation through the frictional clutch will be described first.

In a ribbon clutch winding enable state shown in FIG. 9A, the ribbon cam 17 is set in a state represented by P1 and P6 in the cam chart shown in FIG. 7, and the clutch winding lever 25 is biased clockwise (i.e., the direction of the arrow F1) by the winding lever biasing spring 28. The clutch drive gear 25*a* mounted on the clutch winding lever 25 is biased toward the intermediate gear R26 and is meshed with it.

In this state, when the carriage 14 is moved in a recording direction (i.e., the direction of the arrow B1 in FIG. 2), the winding gear 27 meshed with the rack 13 is rotated.

A rotation force of the winding gear 27 is transmitted to the clutch gear portion 23*b* through the winding intermediate gear R26 and the clutch drive gear 25*c* and to the hub seat 23*a* by the friction of the felt pad surface. Upon rotation of the hub seat 23*a*, the winding core 44 in the ink ribbon cassette 40 which is meshed with the hub seat 23*a* is rotated, thereby winding the ink ribbon 49.

In this state, as shown in FIG. 7, the head is set in the DOWN state, and the ink ribbon 49 is urged against the recording sheet 4 by the thermal head 18 (to be described later). When the carriage 14 is moved in the recording direction (i.e., the direction of the arrow B1 in FIG. 2), the ink ribbon 49 is pulled by the friction with the recording sheet 4. A winding force of the ink ribbon by the clutch has a magnitude enough to remove slackening of the ink ribbon 49. An unnecessary large winding force causes slippage between the ink ribbon 49 and the recording sheet 4 and contamination on the recording sheet 4. The number of revolutions of the clutch gear portion 23*b* is larger than that in winding by the hub seat 23*a*, thereby performing stable winding by the slipping clutch.

When the ribbon cam 17 is rotated clockwise or counterclockwise (the direction of the arrow D1 or an arrow D2 in FIG. 9A from this state, the cam surface 17*b* formed in the ribbon cam 17 abuts against a boss 25*b* formed at one end of the clutch winding lever 25. When the ribbon cam 17 is further rotated, the radius of the cam surface 17*b* at the point of contact between the cam surface 17*b* and the boss 25*b* of the clutch winding lever 25 is increased in accordance with the cam chart of FIG. 7.

The clutch winding lever 25 is rotated counterclockwise (i.e., the direction of the arrow F2 in FIG. 9A) against the biasing force of the winding lever biasing spring 28. When the cam surface 17*b* reaches the position indicated by P2 to P5 of the cam chart of FIG. 7, the clutch drive gear 25*c* guided and supported by the clutch winding lever 25 is separated from the winding intermediate gear R26.

In this state, when the carriage 14 is moved in the image recording direction (i.e., the direction of the arrow B1 in FIG. 2), the winding gear 27 meshed with the rack 13 is rotated, and the rotation force is transmitted to the intermediate gear R26. However, since the winding intermediate gear R26 is kept separated from the clutch drive gear 25*c*, the rotation force of the winding gear 27 is not transmitted to the clutch drive gear 25*c*.

That is, in the state indicated by P2 to P5 in the cam chart of FIG. 7, ribbon clutch winding is not performed.

Ribbon direct winding will be described below.

In the ribbon direct winding enable state shown in FIG. 9B, the head cam 16 is set in a state indicated by P2 and P5 of the cam chart in FIG. 7, and the direct winding lever 60 is kept biased in the counterclockwise direction (i.e., the direction of the arrow F2) by the winding lever biasing spring 62. The direct drive gear 60*c* mounted on the direct winding lever 60 is biased toward the intermediate gear L61 and meshed with it. In this state, when the carriage 14 is moved in the image recording direction (i.e., the direction of the arrow B1 in FIG. 4), the winding gear 27 meshed with the rack 13 is rotated. A rotation force of the winding gear 27 is transmitted to the direct gear portion 23*c* through a winding intermediate gear L61 and the direct drive gear 60*c*. Upon rotation of the hub seat 23*a*, the winding core in the ink ribbon cassette 40 which is fitted in the hub seat 23*a* is rotated to perform winding of the ink ribbon 49.

When the head cam 16 is rotated clockwise or counterclockwise (i.e., the direction of the arrow D1 or D2 in FIGS. 9A and 9B) in this state, the cam surface 16*b* of the head cam 16 is brought into contact with a boss 60*e* formed at one end of the direct winding lever 60. When the head cam 16 is further rotated, the radius of the cam surface 16*b* at the point of contact between the cam surface 16*b* and the boss 60*b* of the direct winding lever 60 is increased in accordance with the cam chart in FIG. 9.

The direct winding lever 60 is rotated clockwise (the direction of the arrow F1 in FIGS. 9A and 9B) against the biasing force of the winding lever biasing spring 62. When the cam surface 16*b* reaches the position indicated by P1, P3, P4, and P6 in the cam chart of FIG. 7, the direct drive gear 60*c* guided by the direct winding lever 60 is separated from the winding intermediate gear L61.

In this state, when the carriage 14 is moved in the image recording direction (the direction of the arrow B1 in FIG. 2), the winding gear 27 meshed with the rack 13 is rotated, and a rotation force is transmitted to the winding intermediate gear L61. However, since the winding intermediate gear L61 is kept separated from the direct drive gear 60*c* as described above, a rotation force of the winding gear 27 is not transmitted to the direct drive gear 60*c*.

That is, ribbon direct winding is not performed in the state represented by P1, P3, P4, and P6 in the cam chart of FIG. 7.

A gear transmission mechanism consisting of the winding gear 27, the winding intermediate gear L61, the direct drive gear 60*c*, and the direct gear portion 23*c* has a gear ratio for winding the ribbon at a higher velocity than the ribbon winding velocity during image recording.

The UP/DOWN mechanism for the thermal head (recording head) 18 will be described below.

Figure 10:
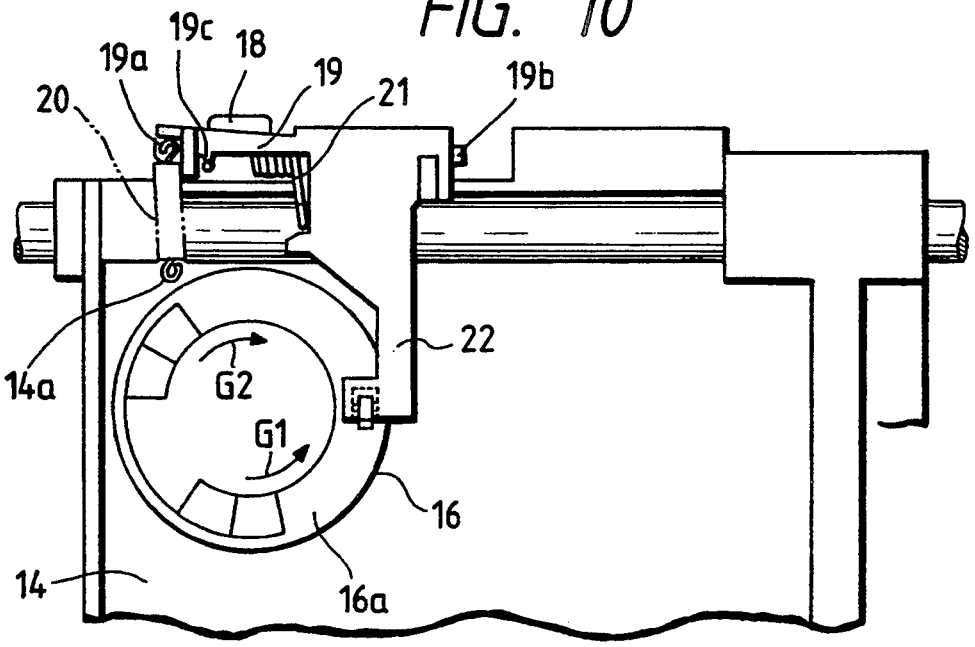
FIG. 10 is a plan view showing a head UP/DOWN mechanism.
Figure 11:
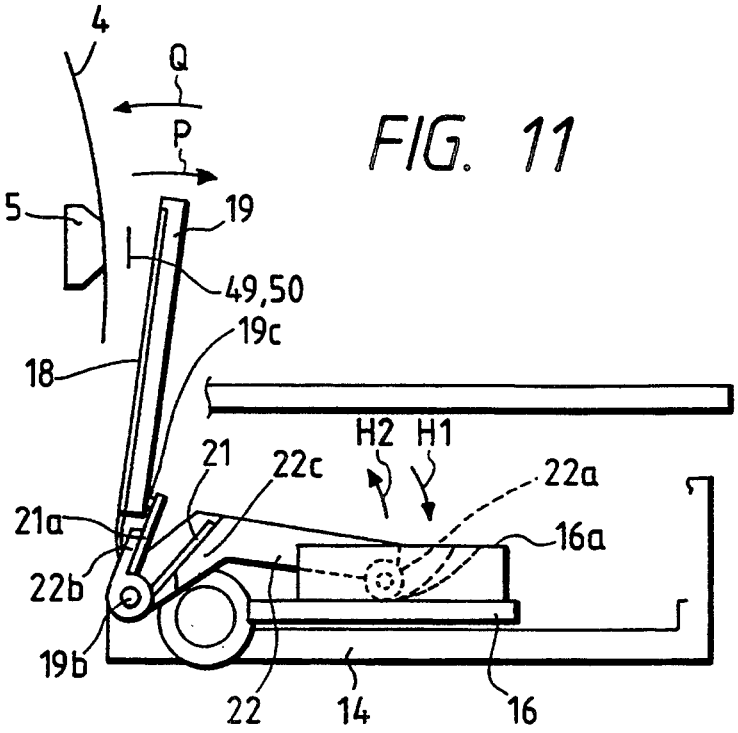
FIG. 11 is a side view showing a head UP state of the head UP/DOWN mechanism in FIG. 10.
Figure 12:
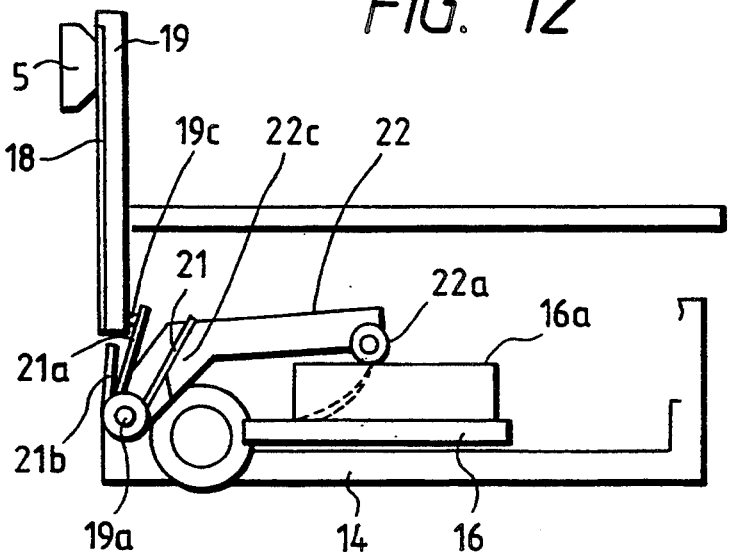
FIG. 12 is a side view showing a head DOWN state of the head UP/DOWN mechanism in FIG. 10.

FIG. 10 is a plan view of the UP/DOWN mechanism, FIG. 11 is a side view showing a head UP state, and FIG. 12 is a side view showing a head DOWN state.

Referring to FIGS. 10 to 12, a head UP/DOWN lever 22 is rotatable about the head holder shaft 19*b* disposed in the carriage 14, and a head spring 21 is arranged between projection portions 22*b* and 22*c* of the head UP/DOWN lever 22 while the spring force is charged by the spring 21.

A roller 22*a* is rotatably guided and supported at one end of the head UP/DOWN lever 22. A head return spring 20 is arranged between a hook 19*a* of the head holder 19 and a hook 14*a* of the carriage 14 to bias the head holder 19 away from the platen 5 (i.e., a direction of an arrow P in FIG. 11).

A biasing force of the head return spring 20 is transmitted from an abutment portion 19*c* of the head holder 19 to an arm 21*a* of the head spring 21 and is then transmitted from the arm 21*a* to a head UP/DOWN lever 22. The head UP/DOWN lever 22 is therefore biased by the head return spring 20 in a direction away from the platen 5 (the direction of the arrow P in FIG. 11), and the roller 22*a* arranged in the UP/DOWN lever 22 is urged against the cam surface 16*a* of the head cam 16.

The head 18 is pivoted in the direction of the platen 5 by an increase in height of the head cam 16.

An operation of bringing the recording head having the above arrangement into contact (DOWN) with the platen and separating it therefrom (UP) will be described below.

Referring to FIGS. 10 and 11, in the head UP (separation) state, the head cam 16 is set in a position represented by P2 to P5 in the cam chart of FIG. 9, and the head UP/DOWN lever 22 is kept in tight contact with the head cam 16 by the head return spring 20, as described above. The head 18 is kept separated from the recording sheet 4 and the platen 5.

In this state, when the head cam 16 is rotated clockwise (i.e., a direction of an arrow G2 in FIG. 10) or counterclockwise (i.e., a direction of an arrow G1 in FIG. 10), a height of the cam surface at a point of contact between the cam head 16 and the roller 22*a* arranged in the head UP/DOWN lever 22 is increased.

The head UP/DOWN lever 22 is rotated counterclockwise (i.e., a direction of an arrow H in FIG. 11) against the biasing force of the head return spring 20. A rotation force of the head UP/DOWN lever 22 is transmitted from the arm 21*a* of the head spring 21 to the abutment portion 19*c* of the head holder 19 to rotate the head holder 19 counterclockwise (a direction of an arrow Q in FIG. 11). The thermal head 18 mounted on the head holder 19 is urged against the platen 14 through the recording sheet 4 and the ink ribbons 49 and 50 (FIG. 11).

That is, during recording by the thermal head 18, the head 18 is in tight contact with the recording sheet 4 through the ink ribbon 49 or the ink ribbon 50, and the recording sheet 4 is kept at this position by the platen 5.

After the thermal head 18 is brought into contact with the platen 5, the height of the head cam 16 is increased to rotate the head UP/DOWN lever 22 counterclockwise (a direction of an arrow H2 in FIG. 11).

That is, in a state wherein the head cam 16 reaches the position indicated by P1 and P6 in the cam chart of FIG. 7, movement of the head holder 19 is restricted by abutment between the thermal head 18 and the platen 5.

Upon counterclockwise (the direction of the arrow H2 in FIG. 11) rotation of the head UP/DOWN lever 22, the head spring 21 further charges the spring force since it is separated from the projection 22*b* of the head UP/DOWN lever 22.

The spring force of the head spring 21 is transmitted to the abutment portion 19*c* of the head holder 19 since the head spring 21 is separated from the projection portion 22*b* of the head UP/DOWN lever 22. The thermal head 18 is urged against the platen 5 through the recording sheet 4.

The head UP/DOWN operation, the ribbon winding operation, and the cassette UP/DOWN operation will be described below.

Combinations of the positions of the head UP/-DOWN operation, the ribbon winding ON/OFF operation, and the cassette UP/DOWN operation will be described using the cam chart in FIG. 7.

Referring to FIG. 7, P1 represents a state (position) in which a head DOWN state (contact) is set, a ribbon clutch winding can be performed, and the cassette DOWN state is set (i.e., the upper cassette can be used). That is, the state (position) P1 represents a recording skate by using the upper ink ribbon cassette.

P2 represents a state (position) in which a head UP state (separation) is set, ribbon direct winding can be used, and a cassette DOWN state is set. That is, the state (position) P2 represents a state (position) in which the upper cassette ribbon can be wound in the nonrecording state.

P3 represents a state (position) in which a head UP state is set, a ribbon winding state is released, and a cassette DOWN state is set. P4 represents a state (position) in which a head UP state is set, ribbon winding is released, and a cassette UP state is set (the lower cassette can be used).

P5 represents a state (position) in which a head UP state is set, ribbon direct winding can be performed, and the cassette UP state is set. That is, the lower cassette ribbon can be wound in the nonrecording state.

P6 represents a state (position) in which a head DOWN state is set, ribbon clutch winding can be performed, and the cassette UP state is set. That is, the state (position) P6 represents a recording state by using the lower cassette.

When the head motor M3 (FIG. 4) is rotated clockwise or counterclockwise to set the head cam 16 and the ribbon cam 17 to any one of the positions P1 to P6, one of the eight states, i.e., an image recording state, an image nonrecording state, a ribbon clutch winding release state, a ribbon clutch winding enable state, a ribbon direct winding release state, a ribbon direct winding enable state, a cassette UP state, and a cassette DOWN state, can be selected.

The eight states can be selected by a combination of the head UP/DOWN operation and the ribbon clutch winding ON/OFF operation. Alternatively, the head UP/DOWN operation, the ribbon winding ON/OFF operation, and the cassette UP/DOWN operation may be independently performed by three motors, respectively.

The ink sheet cassette (ink ribbon cassette) will be described with reference to FIG. 13 (plan view) and FIG. 14 (perspective view).

Figure 13:
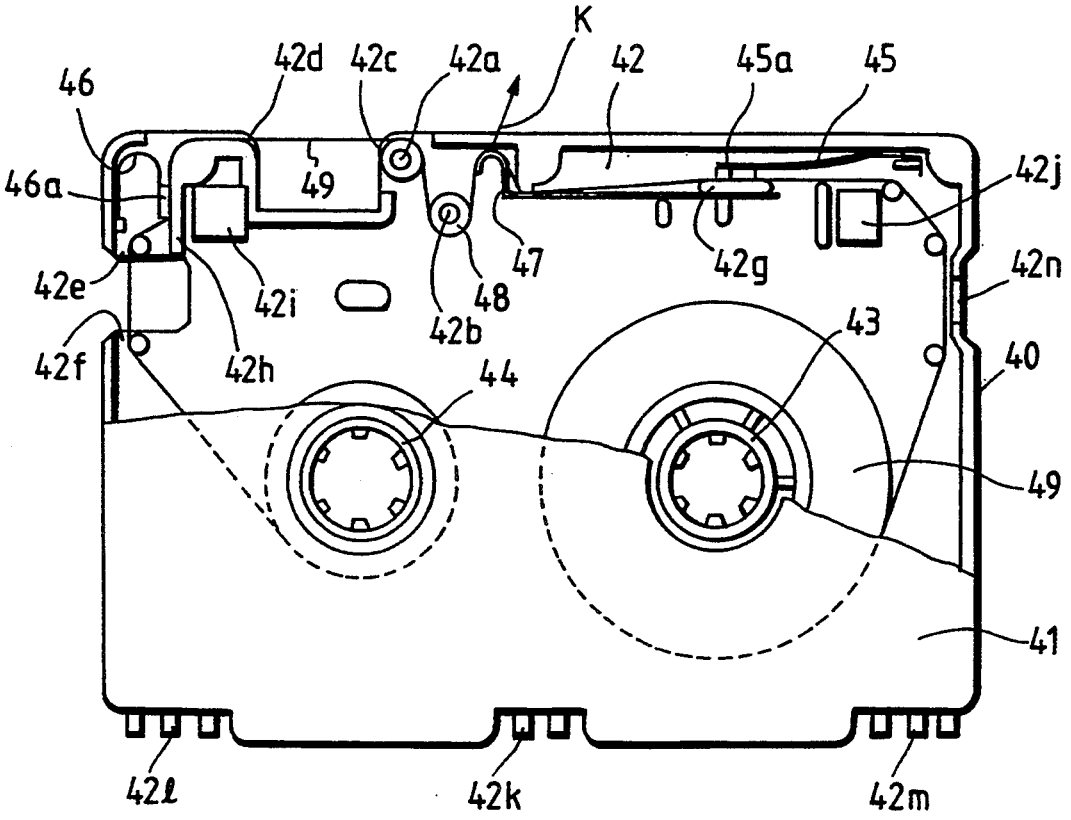
FIG. 13 is a partially cutaway plan view of an ink sheet cassette.
Figure 14:
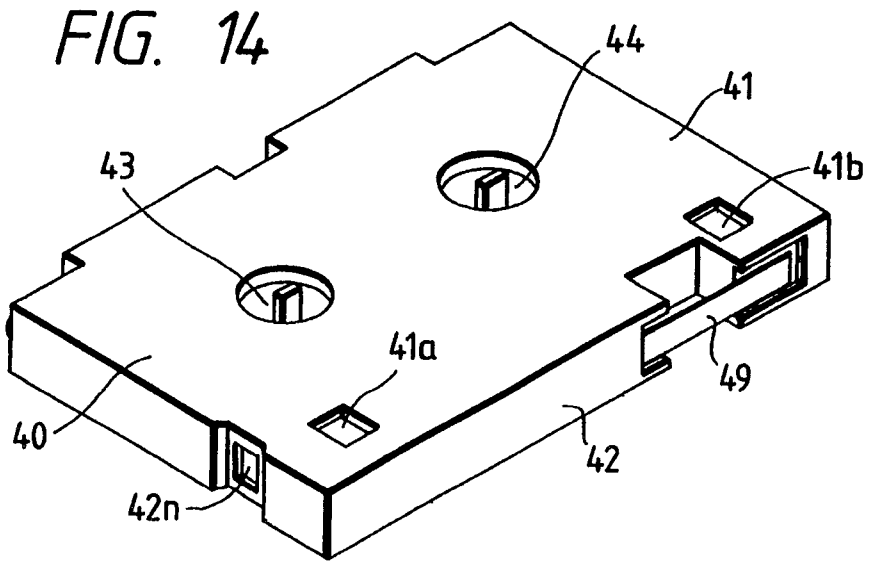
FIG. 14 is a perspective view showing an outer appearance of the ink sheet cassette shown in FIG. 13.

Referring to FIGS. 13 and 14, the ink ribbon cassette 40 includes an upper case 41 and a lower case 42. The ink ribbon cassette 40 is detachably loaded on the carriage table 35 while storing the ink ribbon 49 therein.

The ink ribbon 49 is wound around a supply core 43 and is guided outside the cassette 40 through an opening 42*c* of the lower case via rollers 48 rotatably mounted on projection portions 42*a* and 42*b* of the lower case 42. The ink ribbon 49 enters into the cassette 40 again from an opening 42*d* of the lower case and is then exposed outside the cassette 40 through an opening 42*e* of the lower case. The ink ribbon 49 then enters into the cassette 40 through an opening 42*f* of the lower case and is then wound around the winding core 44.

When the cassette 40 is loaded on the carriage table 35 at a predetermined position, the ink ribbon 49 exposed from the openings 42*c* and 42*d* of the cassette 40 at positions opposite to the head 18 of the main body. The exposed portions of the ink ribbon 49 can be heated by the thermal head 18 heated in accordance with the recording information. The ink ribbon 49 is biased against projection portions 42*g* and 42*h* of the lower case 42 by the compression spring 45 and a compression spring 46 arranged in the lower case 42. Felt members 45*a* and 46*a* are adhered to the compression springs 45 and 46, respectively, to prevent damage to the ink ribbon 49 upon contact.

A tension spring 47 biases the ink ribbon 49 in a direction of an arrow K (FIG. 13) and cooperates with the compression springs 45 and 46 to eliminate slackening of the ink ribbon 49.

Part of the ink ribbon 49 is exposed from an opening 42*n* of the lower case 42. When the cassette 49 is loaded on the carriage table 35 at a predetermined position, the ribbon sensor S2 (FIG. 2) is located at a predetermined position of the carriage table 35 and detects a ribbon end of the ink ribbon 49. The color sensor S3 (FIG. 2) opposes the ink ribbon 49 exposed from the openings 42*e* and 42*f* of the lower case 42.

A multi-ribbon (multi-color ink ribbon) will be described with reference to FIG. 15.

Figure 15:
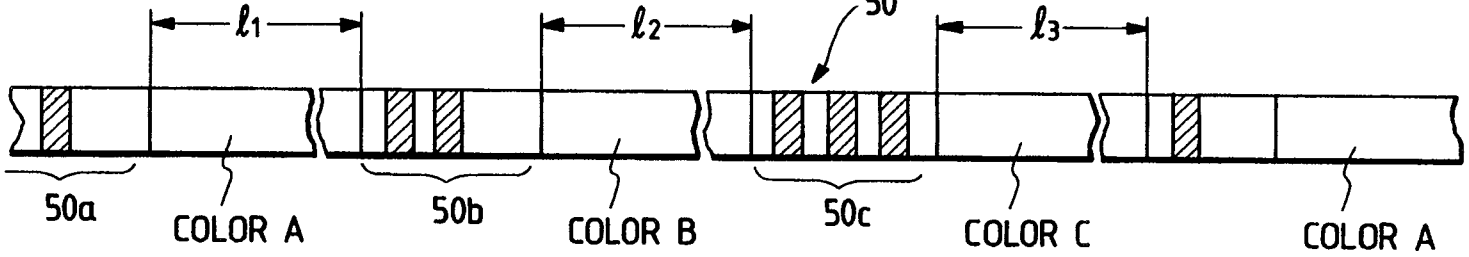
FIG. 15 is a view showing a structure of a multi-ink ribbon.

The multi-ribbon 50 shown in FIG. 15 is a typical example of the ribbon. A plurality of colors (A, B, and C colors) of inks are applied in a shape of stripes on the multi-ribbon 50 through bar codes 50*a*, 50*b*, and 50*c*. That is, the bar codes 50*a*, 50*b*, and 50*c* are formed in correspondence with the colors, respectively. The bar code 50*a* having a small width is formed for the A color, the car code 50*b* having an intermediate width is formed for the B color, and the bar code 50*c* having a large width is formed for the C color.

The colors are not limited to the A, B, and C colors, and the number of colors can be arbitrarily determined.

The multi-ribbon 50 is stored in the ink ribbon cassette 40 as in the ink ribbon 49.

When the ribbon cassette 40 is loaded on the carriage 35 at the predetermined position, as described above, the color sensor S3 (FIG. 2) on the main body opposes the position of the multi-ribbon exposed through the openings 42*e* and 42*f* of the lower case 42.

When the multi-ribbon 50 is wound by the winding core 44, the bar codes 50*a*, 50*b*, and 50*c* on the multi-ribbon 50 are detected by the color sensor S3 to discriminate the next color of the detected bar code. The bar codes may be distinguished from each other by the number of black lines as shown in FIG. 15 or by the widths of the black lines. Therefore, the forms of the bar codes are not limited to specific ones.

Figure 16:
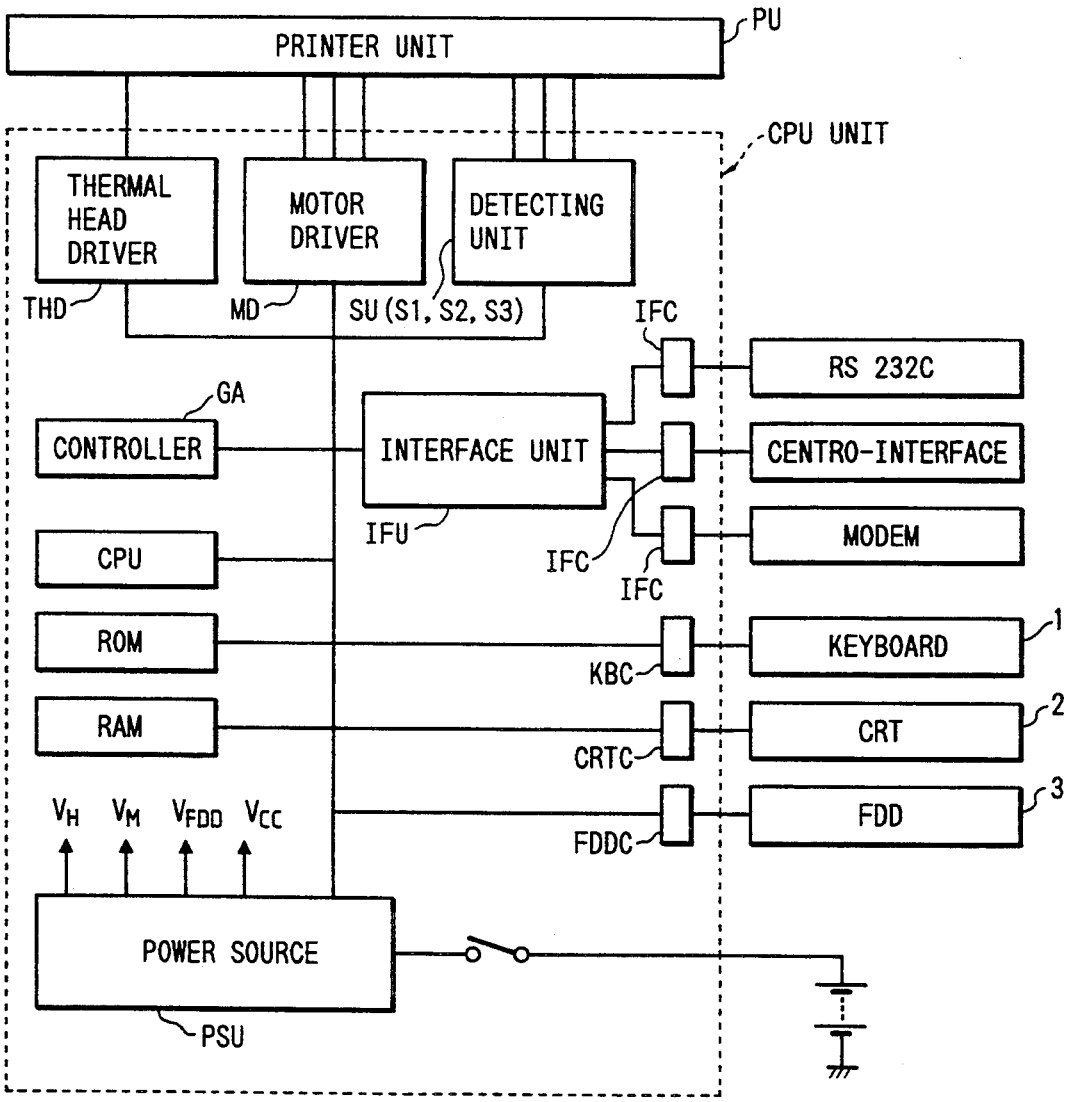
FIG. 16 is a block diagram of a control system in the recording apparatus according to the present invention.

FIG. 16 is a block diagram showing an arrangement of the image recording apparatus described above.

FIG. 16 shows only connections of the blocks, and detailed control lines are omitted. A portion surrounded by the dotted line is a CPU unit.

The CPU is a central processing unit for reading out programs and various data from a ROM and an FDD (both of which will be described in detail later), performs necessary arithmetic operations and determination, and performs various control operations. The CPU may be constituted by a plurality of units.

A ROM is a read-only memory for storing various programs for operating the CPU, character codes, dot patterns (character generator: CG), and various data necessary for printing. A RAM is a read/write memory which consists of a working area for temporarily storing instruction data and arithmetic results, a buffer area for storing various data input from the keyboard 1, an external interface unit IFu, or the floppy disk FDD3, and a text area for storing a document.

The CPU unit is connected to a printer unit Pu through a thermal head driver THD, a motor driver MD, and a detecting unit SU.

The thermal head driver THD drives the thermal head 18 arranged in the printer unit Pu under the control of the CPU. The motor driver MD drives the sheet feed motor M1, the carriage motor M2, and the head motor M3, and the like under the control of the CPU.

The detecting unit Su transmits detection data from a home position sensor S1, the ribbon sensor S2, the color sensor S3 or the like arranged in the printer unit Pu to the CPU.

A power source PSu supplies a drive power source VH for the thermal head 25, a drive power source VM for the recording sheet feed motor M2, the carriage motor M2, the head motor M3, and the like, a drive power source VFDD for the floppy disk FDD3, and a power source VCC for other logic circuits.

A controller GA transfers printing data to the thermal head 18, changes the voltage/current of the power source VH, changes a heating time and a duty ratio, and performs any other control operation under the control of the CPU.

The keyboard 1 is connected to the CPU unit to input various data necessary for printing and editing through a keyboard connector KBC.

The CRT 2 is also connected to the CPU unit to display data input from the keyboard 1 through the CRT connector CRTC and various data. Another display unit such as a liquid crystal display unit may be used in place of the CRT 2.

The floppy disk FDD3 is connected to the CPU unit through a FDD connector FDDC. A hard disk, an external RAM, an external ROM, or the like can be connected in place of the floppy disk FDD3.

An interface such as RS232C, a CENTRO-interface, or a modem can be connected to the CPU unit to control the recording apparatus by an external controller through an interface connector IFC and to perform communication with an external device.

Although not illustrated, a speech output unit such as a buzzer may be arranged.

Figure 17:
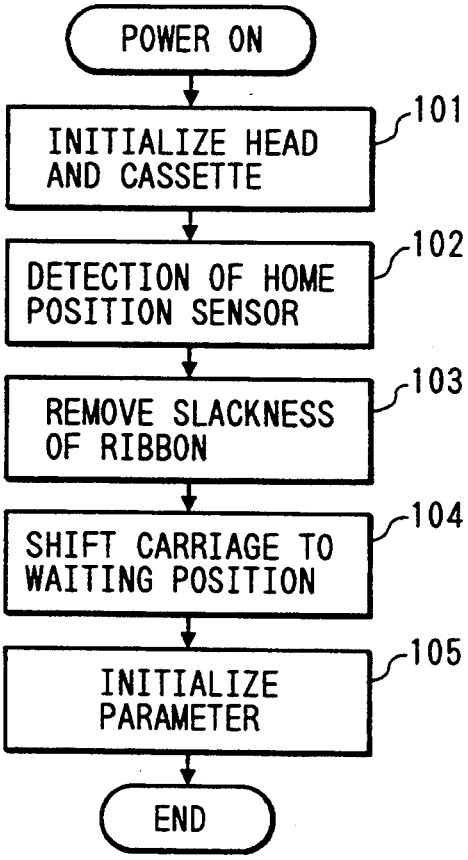
FIG. 17 is a flow chart showing power-on processing of the recording apparatus shown in FIG. 16.

FIG. 17 is a flow chart showing a control operation of power-on processing of the recording apparatus according to the present invention. An operation for controlling the image recording apparatus by the programs stored in the ROM and the FDD will be described with reference to FIG. 17.

At least two cassettes can be loaded in this image recording apparatus. A mono-color ribbon and a multi-color ribbon can be loaded to perform mono-color recording and multi-color recording.

Referring to FIG. 17, when a power switch of the apparatus is turned on (power ON), the head and the cassette are initialized in step 101. The head and cassette are initialized as follows. The thermal head 18 is set in the UP state, and the carriage table 35 is shifted down (cassette DOWN), so that the upper cassette is set in the printable position. A detail of initialization of the head and the cassette will be described later.

In step 102, in order to determine an absolute position of the carriage 14, the carriage motor M2 is driven to shift the carriage 14 to the direction of the home position sensor S1. After the home position sensor S1 detects the home position of the carriage 14, the carriage 14 is stopped.

In step 103, slackening of the ribbon is eliminated to prevent catching of the recording sheet 4 during insertion and assure stable high-quality printing. Elimination of slackening of the ribbon will be described in detail later.

In step 104, the carriage 14 is shifted to the waiting position.

Finally, in step 105, various parameters are initialized. That is, a multi-ribbon set color (MRS) (to be described later) is set to be indefinite, and a multi-ribbon remain (MRL) (to be described later) is set to be zero.

Figure 18:
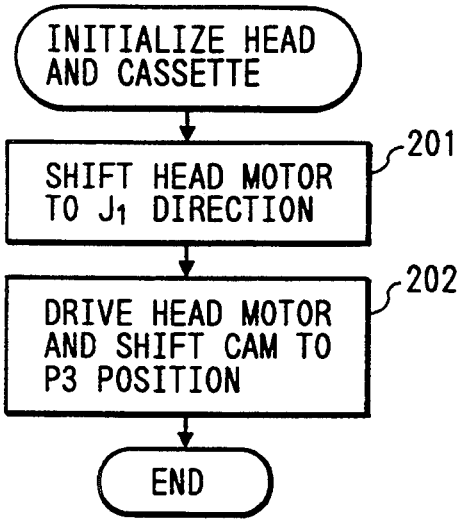
FIG. 18 is a flow chart showing initialization processing (FIG. 17) of positions of a thermal head and a cassette.

FIG. 18 is a flow chart showing initialization processing of head and cassette positions.

Referring to FIG. 18, the head motor M3 is driven in a direction of an arrow J1 in FIG. 4, and the head cam 16 (FIG. 4) and the ribbon cam 17 (FIG. 4) are rotated and are brought into contact with the stopper.

At the time of power-on operation, the cam position is indefinite. However, when the head motor M3 is driven by a total rotation angle or more of the cam to set the head cam 16 and the ribbon cam 17 from any cam positions to the stopper abutment positions.

In step 202, the head motor M3 is driven by a predetermined amount in a direction of an arrow J2 in FIG. 4, and the head cam 16 and the ribbon cam 17 are set to cam positions P3 shown in FIG. 7.

As described above, the thermal head 18 is separated (UP) from the platen 5, and ribbon winding is not performed. The carriage 35 is shifted to the lower direction, i.e., the upper cassette is set to a position where printing can be performed.

Figure 19:
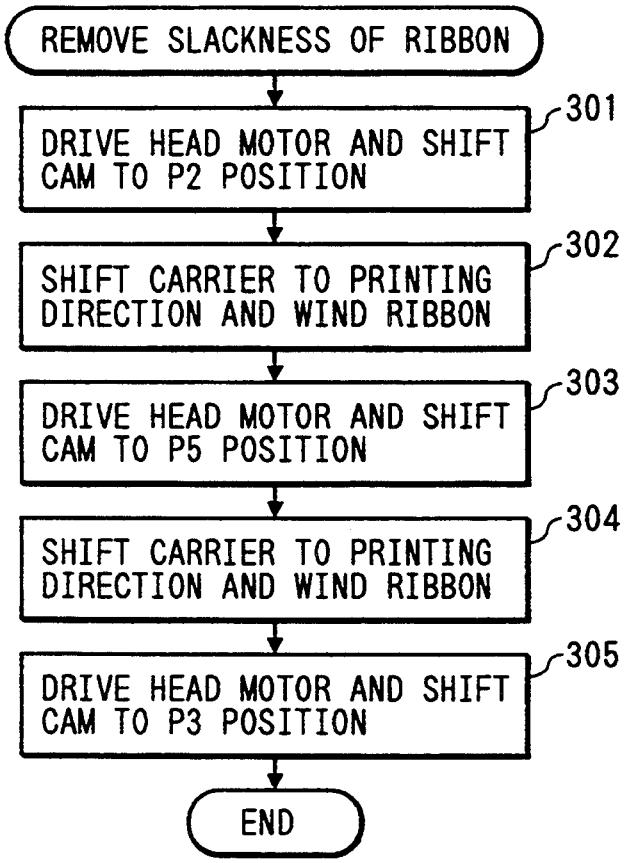
FIG. 19 is a flow chart of ribbon slackening elimination processing.

FIG. 19 is a flow chart showing ribbon slackening elimination.

Referring to FIG. 19, in step 301, the head motor M3 is driven, and the head cam 16 and the ribbon cam 17 are shifted to the cam positions P2 in FIG. 7. In step 302, the carriage motor M2 is driven to shift the carriage 14 to the printing direction.

As described above, since the carriage 14 is shifted in the printing direction at the cam position 2, the hub seat 23*a* is rotated upon direct ribbon winding, and the ink ribbon of the upper cassette is wound to eliminate ribbon slackening.

In step 303, the head motor M3 is driven to shift the head cam 16 and the ribbon cam 17 to the cam positions P5 in FIG. 7. The lower cassette is therefore shifted to a printable position, and the winding core of the lower cassette is engaged with the winding clutch 23.

In step 304, the carriage motor M2 is driven to shift the carriage 14 in the printing direction. As described above, at the cam position P5 (FIG. 7), the carriage 14 is shifted in the printing direction to rotate the hub seat 23*a* upon ribbon direct winding. The ink ribbon in the lower cassette is wound to eliminate slackening.

In step 305, the head motor M3 is driven to shift the head cam 16 and the ribbon cam 17 to the cam positions P3 in FIG. 7, thereby completing the processing.

In the above sequence, ribbon slackening can be removed by performing the operations in an order of steps 303, 304, 301, 302, and 305. When a shift amount of the carriage 14 during ribbon winding is increased, a ribbon winding amount is increased. For this reason, the carriage shift amount must be minimized to prevent wasteful use of the ribbon.

FIG. 20 shows color designation in a document (text).

A desired color is designated with a color designation key at a desired position in the text.

The color designation key may be determined as a color key, or an operation such as a combination of a color key and a numeric key or a combination of a function key and a letter key (e.g., C).

A designation range can be sandwiched by special letters, as shown in FIG. 20, or can be overlapped by a special letter. It is most effective to display the designation range by different colors in a color CRT or LCD to distinguish it from a nondesignation range.

A color designation area cannot be easily distinguished from a nondesignation area in a mono-color CRT or LCD. The color designation area may flash with a key operation, or the brightness of the color designation area may be changed, thereby easily distinguishing the color designation area from other areas.

FIGS. 21A and 21B show color designation in a printing menu, and the printing menu for setting various printing parameters will be described with reference to FIGS. 21A and 21B.

As shown in FIG. 21A, a cassette color is designated in accordance with test color designation shown in FIG. 20.

As shown in FIG. 21B, when a designation operation different from that of the text shown in FIG. 20, the designated part is set to flash, an error message is displayed, or a buzzer tone is produced.

When image recording (printing) is performed against an alarm, the color designation portion of the text is changed with the color designation in the printing menu, and then image recording (printing) is performed.

Various changes can be achieved by color designation in the printing menu without changing color designation of the part in the text. For example, a text designated for multi-color printing is printed in a mono-color mode (e.g., black and red), or a part of the text designated for printing in red is printed in blue.

In order to print a designated area with one color, e.g., black by neglecting color designation, it is possible to designate the upper and lower cassettes as, e.g., black cassettes in accordance with the printing menu. In addition, printing in black can be designated by not designating the lower cassette but by designating the upper cassette.

Color designation in the printing menu on the display screen is exemplified. An input means can designate a color in any portion except for the area of the text. Alternatively, a specific key, and a combination of a specific key and another key may be used to designate a color. That is, printing in a desired color can be performed by designating a cassette color in any portion except for the area of the text.

Figures 1, 22A:
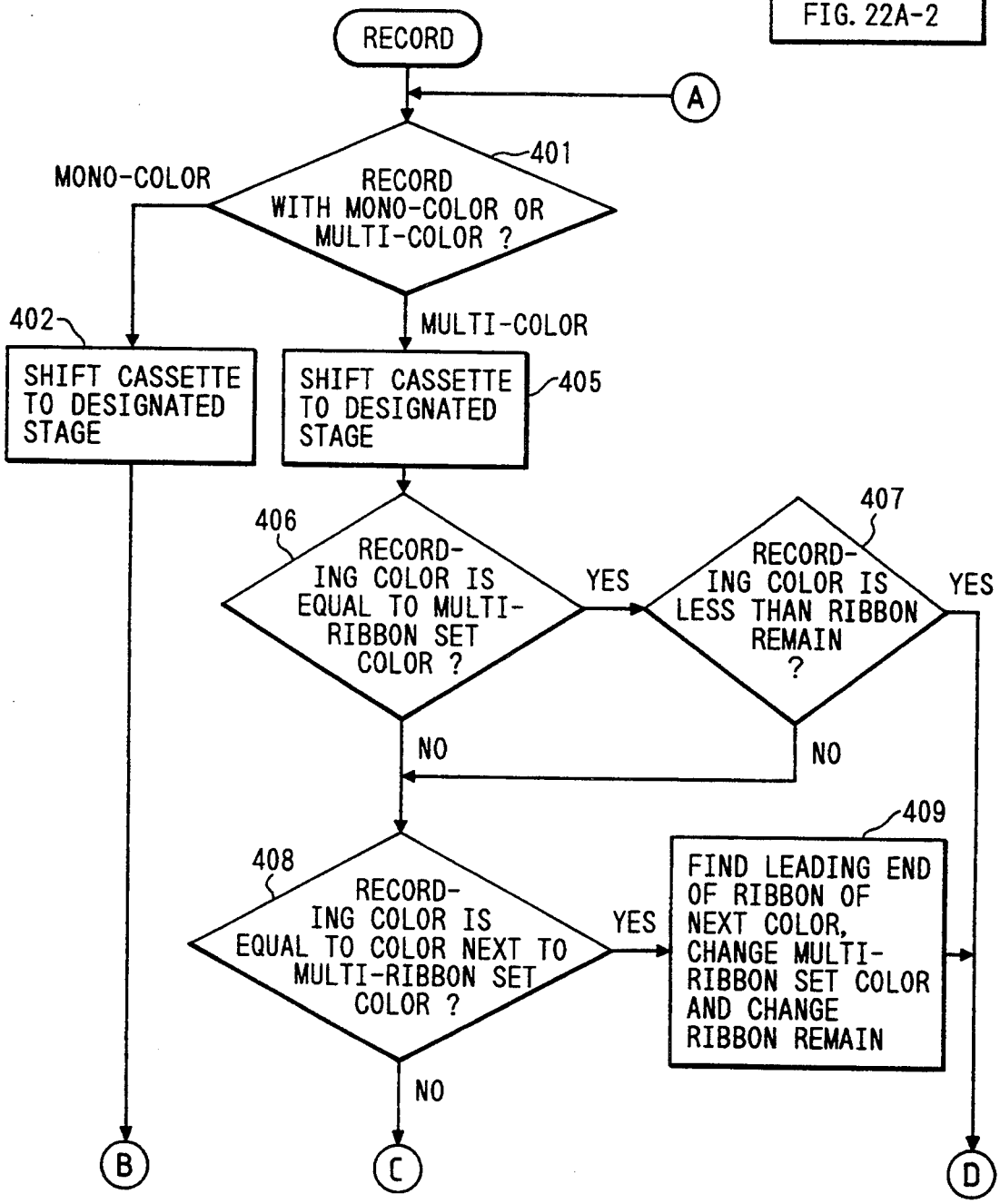
FIG. 22A shows the relationship between the flow charts of FIGS. 22A-1 and 22A-2.
Figures 2, 22A:
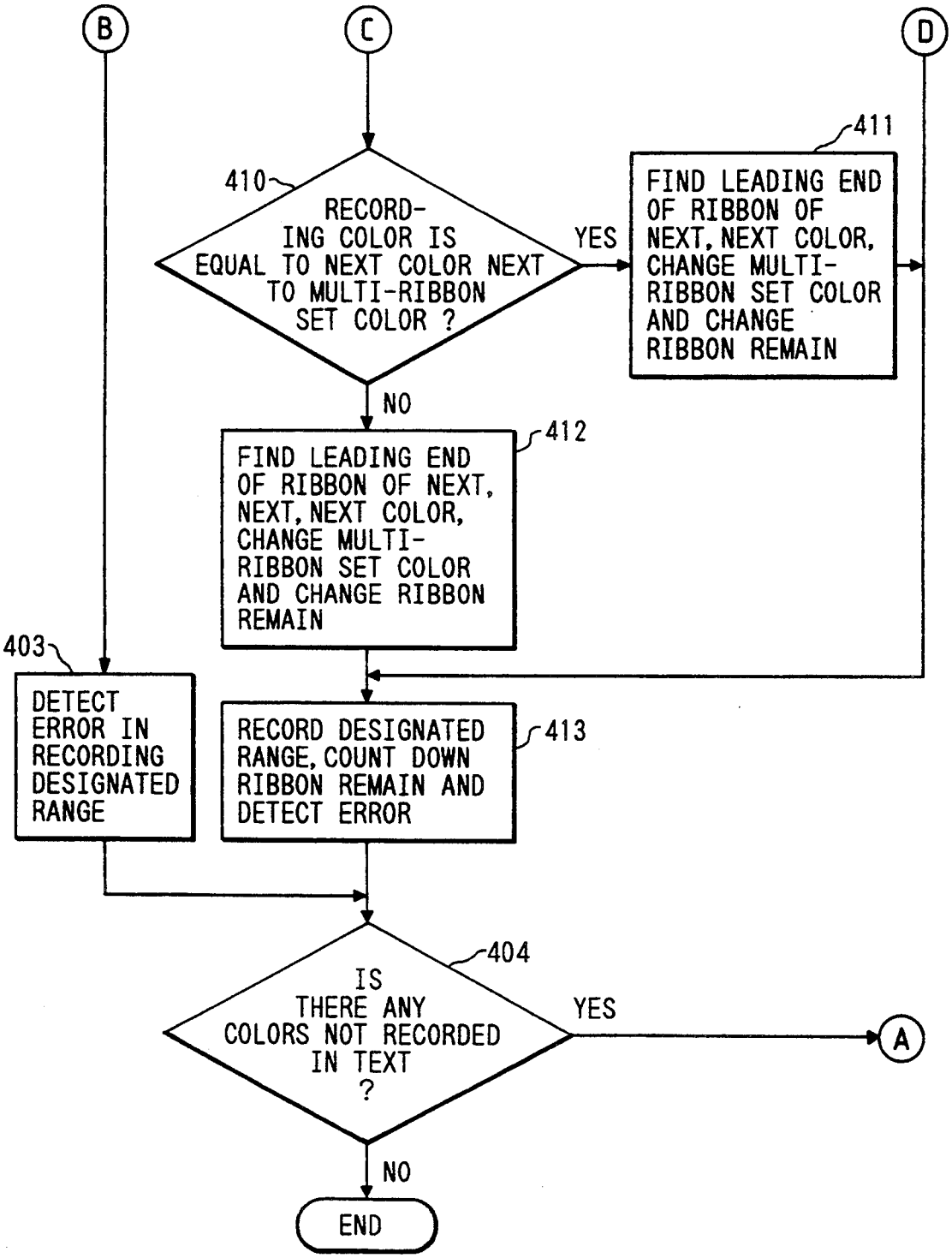
Figure 22B:
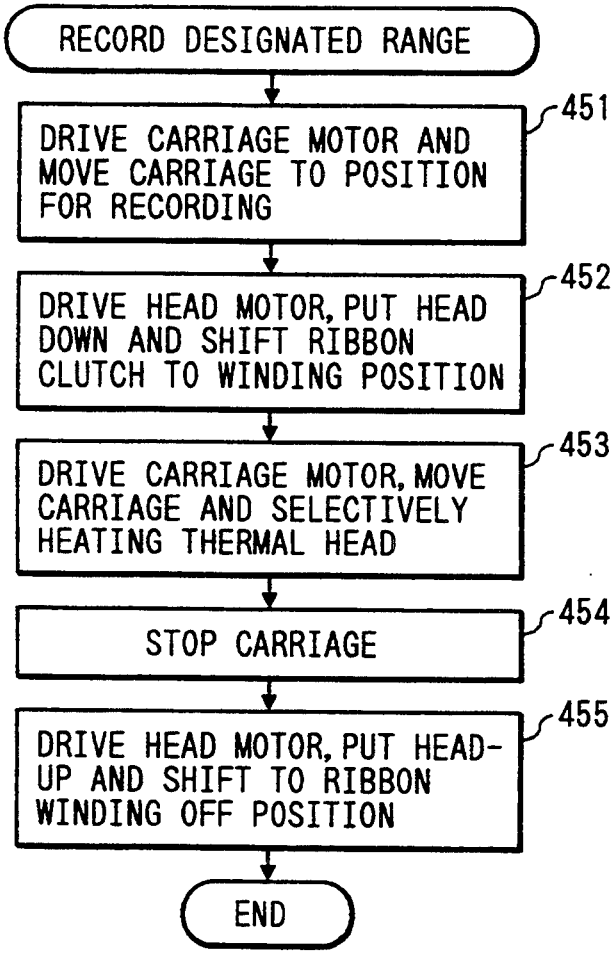

FIG. 22A is a flow chart showing a printing sequence. An operation for printing the text designated in FIG. 20 by using the printing menu designated in FIG. 21A will be described with reference to FIGS. 22A and 22B.

Referring to FIG. 22A, the CPU determines whether a nonprinted color designated by the printing menu is a mono- or multi-color.

If the mono-color or a combination of mono- and multi-colors is determined, the flow advances to step 402. However, when the multi-color is determined, the flow advances to step 405.

In step 402, the cassette is shifted to the designated stage. That is, in upper ribbon printing, the head motor M3 is driven to shift the head cam 16 and the ribbon cam 17 to the cam positions P3 of FIG. 7. However, when the lower ribbon printing is designated, the head cam 16 and the ribbon cam 17 are shifted to the cam positions P4 of FIG. 7.

The flow advances to step 403 to record an image of the designated range and to detect an error. A detail of recording of the image within the designated range is as shown in FIG. 22A. More specifically, in step 451, the carriage motor M2 is driven to move the carriage 14 to the recording designation position. The flow advances to step 452 to drive the head motor M3 to respectively shift the head cam 16 and the ribbon cam 17 to the head DOWN position and the ribbon clutch winding ON position.

The flow advances to step 453 to drive the carriage motor M2 to selectively heat a plurality of heating resistors arranged in the thermal head 18 by the thermal head driver THD in accordance with recording (printing) information while the carriage 14 is kept moved. A thermally fusible ink applied to the ink ribbon is fused and transferred to the recording sheet 4, thereby recording (printing) a designated pattern while the ink ribbon is wound by the clutch.

When recording is completed, the flow advances to step 454 to stop driving the carriage motor M2, so that the carriage 14 is stopped. The flow then advances to step 455 to drive the head motor M3 to shift the head cam 16 and the ribbon cam 17 respectively to the head UP position and the ribbon winding OFF position. That is, in upper ribbon recording, the head cam 16 and the ribbon cam 17 are shifted to the cam positions P3 in FIG. 7. However, in lower ribbon printing, the head cam 16 and the ribbon cam 17 are shifted to the cam positions P4 in FIG. 7.

Image recording within the designated range is thus completed.

A detail of error detection in step 403 will be described in detail later.

When recording within the designated range is completed in step 403, the flow advances to step 404.

When the flow advances to step 405 upon multi-color determination in step 401, the cassette is shifted to the stage designated with the multi-color.

The flow then advances to step 406 to determine whether nonrecorded colors include the present multi-ribbon set color (MRS).

If YES in step 406, the flow advances to step 407. Otherwise, the flow advances to step 408.

For example, if the MRS is the A color, the CPU determines that the A color is a nonrecorded color. Upon the power-on operation, the leading end of the ribbon is not found. Since the multi-ribbon set color (MRS) is set to be indefinite in step 105 of the power-on processing in FIG. 17, the flow advances to step 408.

When the length of the recorded text is shorter than a length corresponding to the multi-ribbon remain in step 407, the flow advances to step 413 and recording is performed.

However, if the ribbon remain is smaller than the value of the length in step 407, and a recording length exceeds a predetermined area of the multi-ribbon in FIG. 15, the flow advances to step 408.

The CPU determines in step 408 whether the recording color is equal to the color next to the present multi-ribbon set color (MRS). For example, when the MRS is the A color, the B color is determined whether to be the nonrecorded color. If YES in step 408, the flow advances to step 409. However, if NO in step 408, the flow advances to step 410.

In step 409, the leading end of the ribbon of the next color (e.g., the B color) is found. A detail of finding of the leading end of the ribbon will be described in detail later. After the leading end of the ribbon is found, the multi-ribbon set color (MRS) is changed to the next color (e.g., the B color), and the present multi-ribbon remain (MRL) is changed to a predetermined amount m. The flow advances to step 413 to perform recording in the next color (e.g., the B color).

The predetermined amount m of the multi-ribbon remain (MRL) is determined by a length l of the ink ribbon in FIG. 15.

The CPU determines in step 410 whether the nonrecorded second succeeding color (i.e., next, next color) of the present multi-ribbon set color (MRS) is included in the nonrecorded colors. For example, if the MRS is the A color, the C color is determined whether to be a nonrecorded color. If YES in step 410, the flow advances to step 411. However, if NO in step 410, the flow advances to step 412.

In step 411, the leading end of the second succeeding color (e.g., the C color) is found, and the multi-ribbon remain (MRL) is set to be the second succeeding color (e.g., the C color), thereby setting the multi-ribbon remain (MRL) to be the predetermined amount m. The flow then advances to step 413, and printing with the second succeeding color (e.g., the C color) is performed.

In step 412, the leading end of the third succeeding color, i.e., next, next, next color, (e.g., the A color) is found, and the multi-ribbon set color (MRS) is set to be the third succeeding color. The multi-ribbon remain (MRL) is set to be the predetermined amount m. The flow then advances to step 413 to perform printing with the third succeeding color (e.g., the A color).

In step 413, recording with the same color as the multi-color ribbon set (MRS) is performed within the designated range.

Recording within the designated range is the same as that in step 403. That is, the contents are the same as in the flow chart of FIG. 22B.

Error detection in step 413 will be described later.

After recording within the designated range is performed, the length of a consumed ribbon is subtracted from the multi-ribbon remain (MRL), and the flow advances to step 404.

The CPU determines in step 404 whether there are any colors not recorded in the text. If YES (present) in step 404, the flow returns to step 401. However, if NO (absent) in step 404, the processing is ended. Therefore, the multi-ribbon is not wastefully wound, and the ribbon can be efficiently used.

A nonrecorded color in the text and a nonrecorded range can be stored, and the following operations are performed to further improve efficiency of use of the multi-color ribbon.

When the length to be printed is determined to be larger than the ribbon remain in step 407, i.e., If NO in step 407, the flow directly advances to step 408 in FIG. 22A. However, the following operations may be performed in place of the above sequence. That is, after printing for the ribbon remain is performed, i.e., when printing is ended in a ribbon zero-remain state after the ribbon remain is counted down in synchronism with printing, the flow then advances to step 408.

In the operation in step 404, the presence/absence of the nonprinted color and the presence/absence of the nonprinted range are determined. If the nonprinted color and range are present, the flow returns to step 404. However, when the nonprinted color and range are not present, the processing is ended.

Printing using the multi-ink ribbon can be performed in a ribbon zero-remain state. Efficiency of ribbon consumption can be further improved as compared with the processing in FIGS. 22A and 22B.

Figure 23:
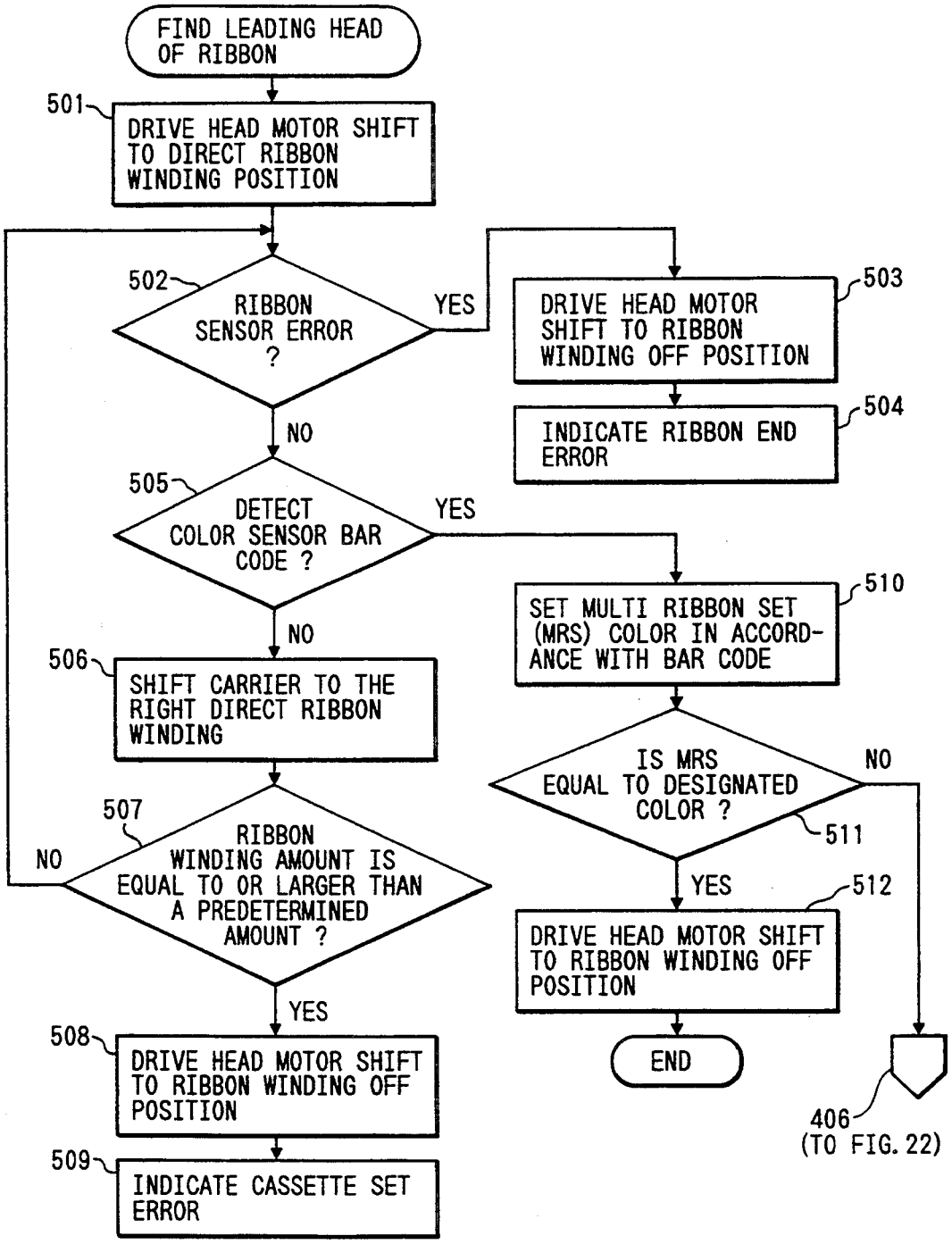
FIG. 23 is a flow chart showing "find leading head" processing in FIG. 22.

FIG. 23 is a flow chart of the "find leading head of ribbon" processing. Finding of the leading end of the multi-ribbon (multi-color parallel-striped coating ink sheet) for color matching will be described with reference to FIG. 23.

The flow in FIG. 23 exemplifies an operation for causing the color sensor S3 to detect the bar codes 50*a*, 50*b*, and 50*c* formed on the multi-ribbon 50 in FIG. 15.

Referring to FIG. 23, in step 501, the head motor M3 is driven to shift the ribbon cam to the ribbon direct winding ON position. That is, the cassette is set in the upper stage (DOWN), the ribbon cam is shifted to the cam position P2 in FIG. 7. However, when the cassette is set in the lower stage (UP), the ribbon cam is shifted to the cam position P5 in FIG. 7.

The CPU determines in step 502 whether the ribbon sensor S2 detects the end of the ribbon.

If YES in step 502, the flow advances to step 503 to drive the head motor M3, thereby setting the ribbon winding OFF state. That is, the ribbon cam is shifted to the cam position P3 in FIG. 7, and the flow advances to step 504, thereby displaying a ribbon end error.

If the ribbon end is not detected in step 502, the flow advances to step 505 to determine whether the color sensor S3 detects a bar code.

If the bar code is not detected (NO) in step 505, the flow advances to step 506 to drive the Carriage motor M2. The carriage 14 is moved in the printing (right) direction to wind the multi-ink ribbon 50. The flow then advances to step 507 to determine whether the ribbon winding amount exceeds a predetermined winding length l (FIG. 15). If NO in step 507, the flow returns to step 502 to repeat ribbon winding and color sensor detection.

If YES (if the ribbon winding amount exceeds the predetermined winding amount) in step 507, this ink ribbon is determined not to be the multi-ink ribbon 50 but the mono-color ink ribbon 49. The flow advances to step 508 to drive the head motor M3 to shift the ribbon cam to the ribbon winding OFF position. The flow then advances to step 509, and a cassette set error is displayed.

When a bar code is detected by the color sensor S3 in step 505, (i.e., if YES in step 505), the flow advances to step 510 to set the multi-ribbon set color (MRS) to be a color corresponding to the detected bar code.

The flow advances to step 511 to determine whether the MRS is a designated color whose leading end is to be found. If NO in step 511, the flow returns to step 406 in FIG. 22A. That is, after the power switch is turned on, the MRS is indefinite, and the next color upon finding of the leading end cannot be determined, so that the previous operating state must be restored.

If YES in step 511, the flow advances to step 512 to drive the head motor M3. The ribbon cam is shifted to the ribbon winding OFF position to complete fining of the leading end of the ribbon having the designated color.

By the above processing, the leading ends of the colors of the multi-ink ribbon are not wastefully found, and efficient finding of the leading end or head can be achieved. In addition, an error found upon insertion of a wrong ink ribbon can be detected.

Figure 24:
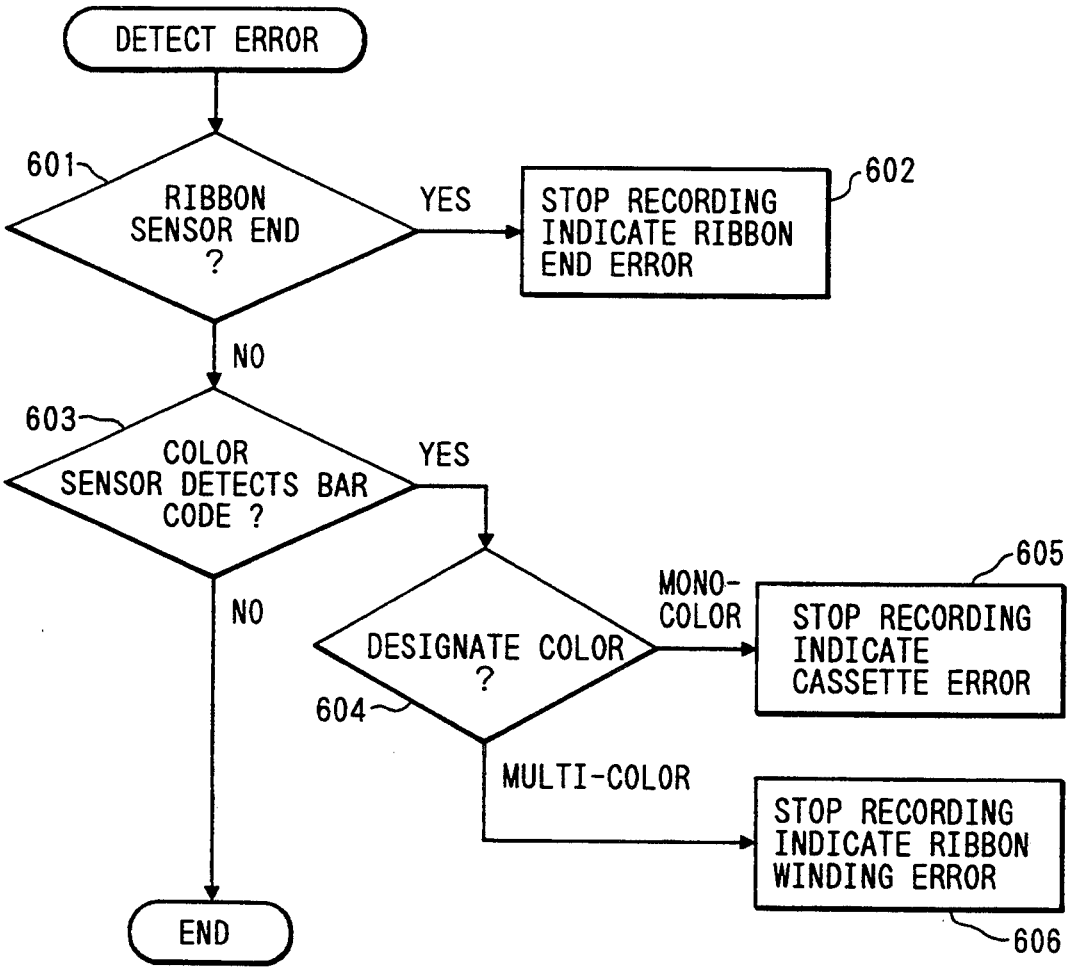
FIG. 24 is a flow chart showing error detection processing shown in FIG. 22.

FIG. 24 is a flow chart of error detection during printing (FIGS. 22A and 22B), as previously described. Error detection during printing will be described with reference to FIG. 24.

Error detection is performed every predetermined interval such as every drive pulse of the carriage motor M2 or every heat cycle of the thermal head 18 during printing.

Referring to FIG. 24, in step 601, the CPU determines whether the ribbon sensor S2 detects a ribbon end.

If YES in step 601, the flow advances to step 602, and printing is interrupted (the carriage 14 is stopped). The head motor M3 is driven to set the thermal head 18 in the head UP position, and the ribbon winding OFF state is set. Thereafter, a ribbon end error is indicated.

When the ribbon end, however, is not detected in step 601, the ribbon is determined to be normal, and the flow advances to step 603 to determine whether a bar code is detected by the color sensor S3.

When the bar code is detected, the color corresponding to the bar code has been heated and recorded during printing. This state is abnormal so that the flow advances to step 604.

The CPU determines in step 604 whether color designation is a mono- or multi-color designation. If mono-color designation is determined, the multi-ink ribbon is erroneously loaded although the mono-color is designated. In this case, the flow advances to step 605 to stop printing, thereby indicating the cassette set error.

In step 604, multi-color designation is determined, no cassette error is indicated, but the color corresponding to the detected bar code has been printed due to a ribbon head finding error or the like. The flow advances to step 606, and printing is stopped. A ribbon winding error is indicated.

When the bar code is not detected (if NO) in step 603, the CPU determines that printing is normally performed, thereby completing the error detection processing.

The error display or indication is generally displayed on the CRT. However, a buzzer may be operated or an alarm lamp may be turned on to signal an error to an operator. The error indication means is not limited to any specific one in the present invention.

Cassette and ink ribbon errors can be detected by the processing described with reference to FIG. 24.

In the above embodiment, various sheets such as a transparent plastic thin sheet used in an overhead projector can be used in addition to recording paper as a recording medium.

The above embodiment exemplifies a thermal transfer system in which the ink ribbon 49 applied with a thermally fusible ink is heated by the thermal head 18. An ink sheet applied with, e.g., a sublimable dye can be used. In addition, an electrothermosensitive recording system for causing an electrode head to energize resistors and to heat an ink sheet applied with an ink may be used. The recording head is not limited to the thermal head 18 but can be replaced with the electrode head, an infrared ray, or a laser beam.

The above embodiment exemplifies a serial recording system in which the thermal head 18 is reciprocated along the recording sheet 4. However, the present invention is not limited to this. The present invention is also applicable to a so-called full-line recording system in which a heating means such as a thermal head shown in FIG. 25 is arranged in the entire recording width.

Figure 25:
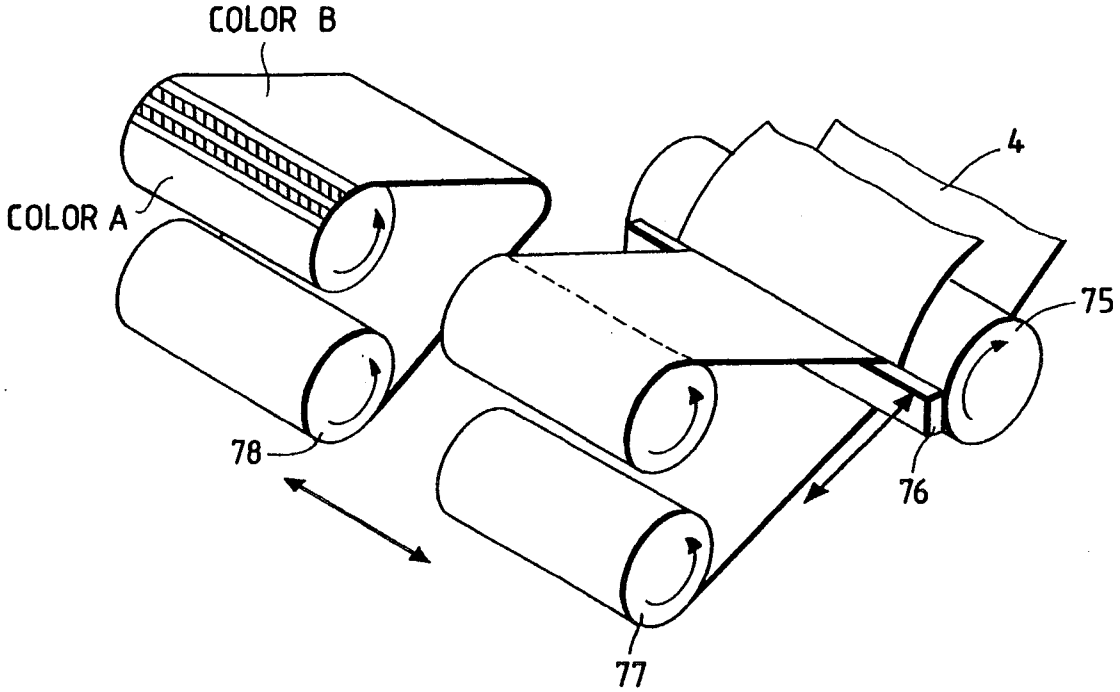
FIG. 25 is a perspective view showing a recording unit in a full-line recording apparatus according to the present invention.

Referring to FIG. 25, a recording sheet 4 is inserted between a platen 75 and a full-line thermal head 76 through a full-line mono-color ink ribbon sheet 77 or a full-line multi-ink ribbon sheet 78. Other arrangements in FIG. 25 are substantially the same as those of the above embodiment. In the arrangement of FIG. 25, motors (not shown) for winding the ink sheets 77 and 78 and a driving force transmission mechanism and its control as in the above embodiment are employed.

In this embodiment, the ink ribbon cassette is loaded on a carriage 14 and is reciprocated. However, the present invention is not limited to this. For example, the present invention is also applicable to a recording apparatus in which an ink ribbon cassette is stationary.

In the above embodiment, the two ink ribbon cassettes are stacked horizontally. However, three or more ink ribbon cassettes may be stacked horizontally.

In the above embodiment, the multi-color ink ribbon is exemplified as a three-color parallel-striped ink ribbon. However, the number of colors may be two, or four or more. The ink ribbon is not limited to the parallel-striped ribbon, but can be a ribbon in which different inks are applied on a base film in a multilayered form. The present invention is applicable to all types of multi-color ink ribbons.

The platen may be a flat platen or a cylindrical platen which also serves as a sheet feed roller.

The heating means is exemplified by the thermal head or the like. The present invention is also applicable to all types of recording apparatuses using ink ribbons. For example, the present invention is applicable to an impact dot type recording apparatus such as a wire dot printer.

In the above embodiment, the black cassette serves as the upper cassette, and the multi-color ink ribbon cassette serves as the lower cassette. However, these cassettes may be reversed. In addition, the multi-color cassette may be designated as the upper or lower cassette in accordance with the printing menu described above.

Another embodiment of the present invention will be described below.

In this embodiment, a bar code ON/OFF time is measured, and a color ink is specified on the basis of its ON/OFF time. Recording is then performed on the basis of the specified color ink.

In another arrangement, a bar code ON time is measured, and a travel velocity of an ink sheet is controlled on the basis of this ON time. A color ink is specified on the basis of the velocity, and recording is performed on the basis of the specified color ink.

Figure 26:
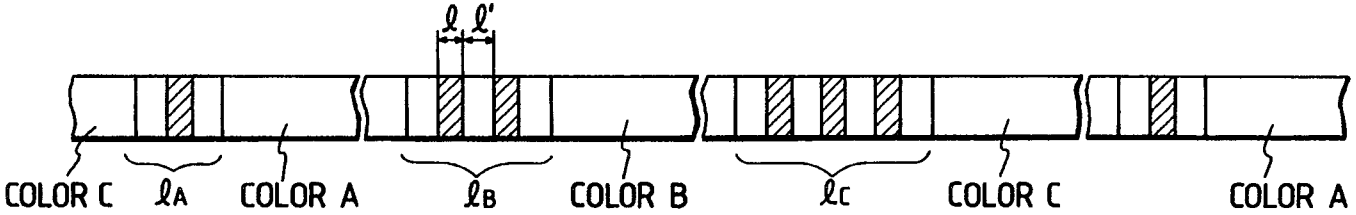
FIG. 26 is a view showing bar codes according to another embodiment of the present invention.

FIG. 26 shows a multi-color ink ribbon according to this embodiment of the present invention. A bar code lA represents the A color, a bar code lB represents the B color, and a bar code lC represents the C color. These colors are detected by the ON/OFF timings of the bar codes. In this case, l represents the width of the bar code, and l′ represents an interval (blank) between the bar codes.

Figure 27A:
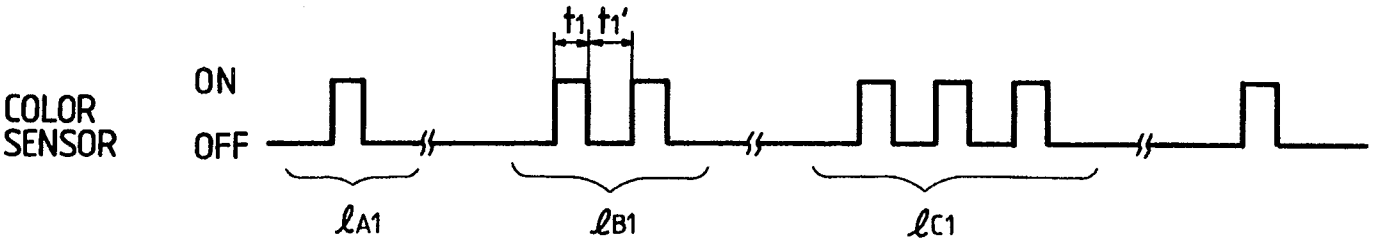
FIGS. 27A and 27B are views showing timings of a color sensor of the embodiment shown in FIG. 26.
Figure 27B:
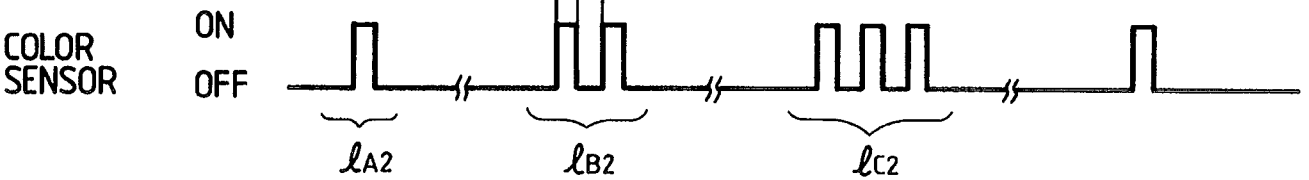

FIG. 27A is a timing chart showing ON and OFF timings of the color sensor in a state wherein a multi-color ribbon is started to be wound. FIG. 27B is a timing chart showing ON and OFF timings of the color sensor at the end of winding of the multi-color ink ribbon. The following conditions are established:

$$t1>t2,\ t1'>t2'$$

where t1 is the ON time of the color sensor at the start of winding of the multi-color ink ribbon, t1′ is its interval, i.e., an OFF time, t2 is the ON time of the color sensor at the end of winding of the multi-color ink ribbon, and t2′ is its interval, i.e., an OFF time.

Figure 28:
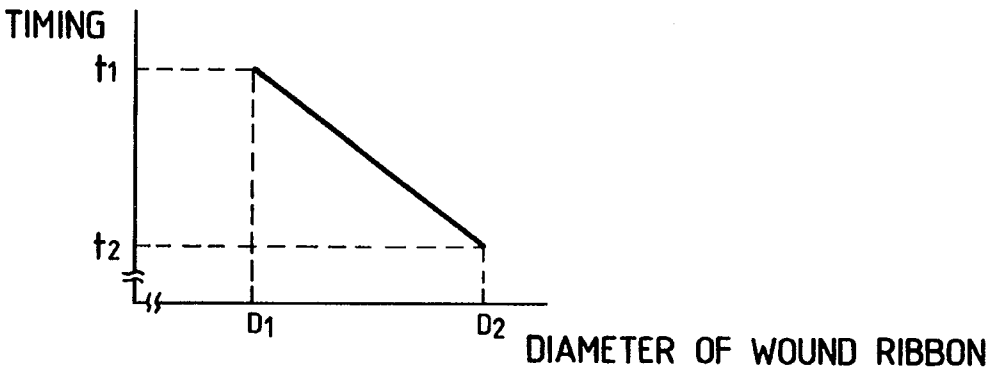
FIG. 28 is a view showing a relationship between a winding radius and a detection timing.

FIG. 28 is a graph showing a relationship between the ON time of the color sensor and the diameter of the wound multi-color ink ribbon.

Bar code maximum and minimum detection times t1 and t2 are defined as follows:

$$t1=l/\{(D1/2)\cdot W\}$$

$$t2=l/\{(D2/2)\cdot W\}$$

where D1 is the diameter (minimum diameter) at the start of winding of the multi-color ink ribbon, D2 is the diameter (maximum diameter) at the end of winding of the multi-color ink ribbon, and W is the winding angular velocity of the multi-color ink ribbon regardless of the diameter. Therefore, $$t1/t2=D2/D1$$

An inverse proportion can be obtained.

Similarly, the bar code maximum and minimum OFF times t1′ and t2′ are defined as follows:

$$t1'=l'/\{(D1/2)\cdot W\}$$

$$t2'=l'/\{(D2/2)\cdot W\}$$

therefore, $$t1'/t2'=D2/D1$$

An inverse proportion can be obtained.

In order to perform color detection by the color sensor, the ON timing falls within the following range:

$$l/\{(D1/2)\cdot W\} \text{ to } l/\{(D2/2)\cdot W\}$$

The OFF timing falls within the following range:

$$l'/\{(D1/2)\cdot W\} \text{ to } l'/\{(D2/2)\cdot W\}$$

Figure 31:
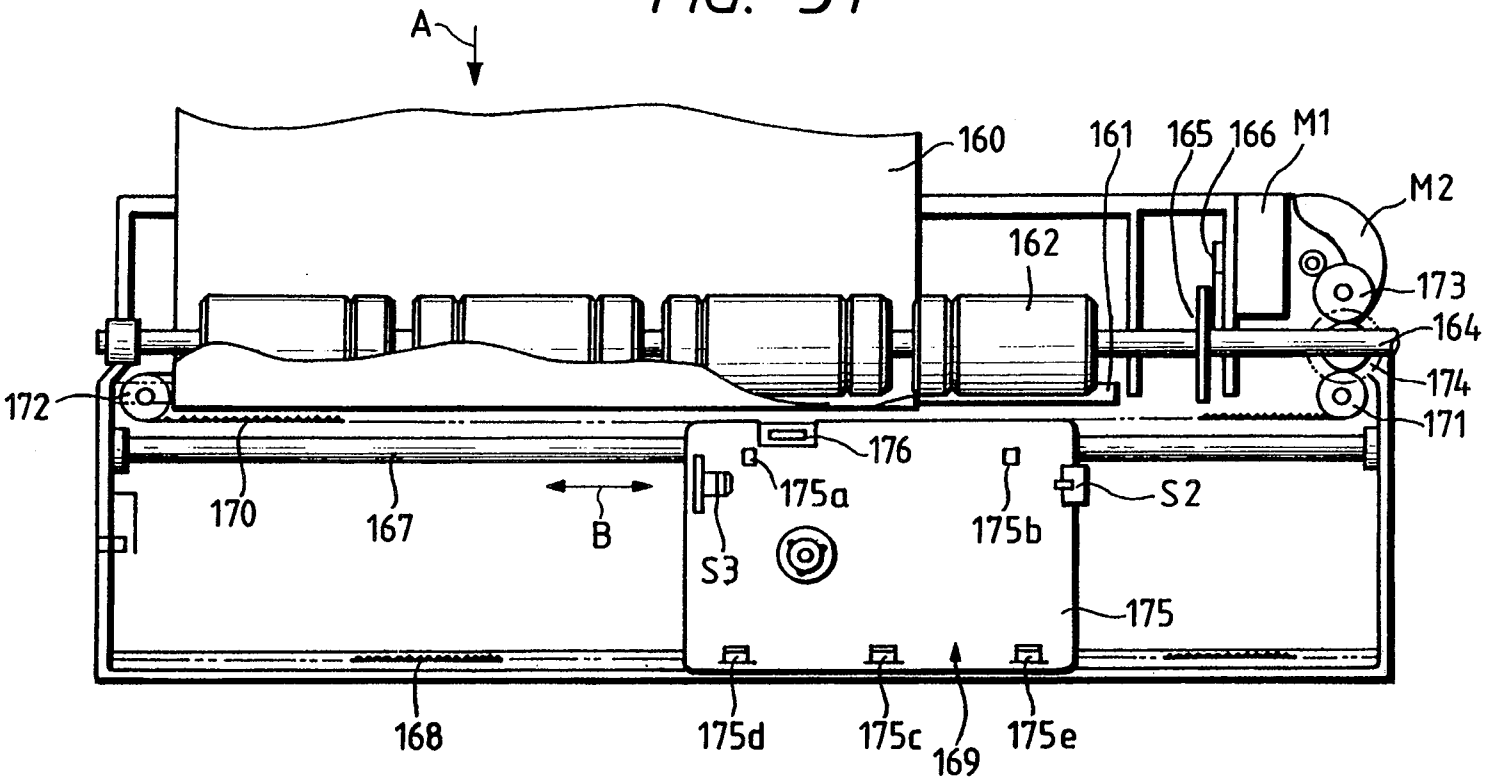
FIG. 31 is a view showing a printer mechanism in which a multi-color ink ribbon cassette is loaded.

FIG. 31 is a view showing a recording unit in a recording apparatus according to this embodiment. Referring to FIG. 31, a recording sheet 160 is urged against a rubber portion of a sheet feed roller 162 by a pinch while the recording sheet 160 is backed up on a platen 161. A gear 165 is mounted on a shaft 164 of the sheet feed roller 162, and the shaft 164 is connected to a sheet feed motor M1 through a reduction gear 166. Upon rotation of the sheet feed motor M1, the sheet feed roller 162 is rotated to feed the recording sheet 160. When a thermal head 176 (to be described in detail later) is brought into contact with the recording sheet 160 to perform image recording, the platen 161 maintains the position of the recording sheet 160.

Reciprocal movement of a carriage 169 will be described below.

A shaft 167 is fixed in front of the platen 161, and a rack 168 is fixed at a position opposite to the carriage 169. The carriage 169 is guided and supported to be movable by the shaft 167 and a guide surface constituted by the upper surface of the rack 168 in directions indicated by a double-headed arrow B.

That is, the carriage 169 can be reciprocated in a direction perpendicular to a feed path A of the recording sheet 160.

Part of a belt 170 is fixed to the carriage 169, and the belt 170 is kept taut by a pulley gear 171 and a pulley 172. The pulley gear 171 is connected to a carriage motor M2 through reduction gears 173 and 174. The pulley gear 171 and the pulley 172 are rotated upon rotation of the carriage motor M2 and the belt 170 is driven. Therefore, the carriage 169 is reciprocated (directions of the double-headed arrow B) along the shaft 167.

A head holder (not shown) is guided and supported by the carriage 169 to be rotatable about a head holder shaft. The thermal head 176 is mounted on the head holder, and the head holder also serves as a heat sink.

A carriage table 175 is mounted on the carriage 169 to stack two ink ribbon cassettes 105 horizontally. A color detecting means (color sensor) S3 for discriminating colors of a multi-color ribbon 106 is arranged on the carriage table 175. A ribbon sensor S3 for detecting the presence/absence and type of the ribbon cassette 105 and the end of the ink ribbon 106 is arranged on the carriage 169.

An operation for loading/unloading the ink ribbon cassettes 105 in/from the carriage table 175 will be described below.

It is possible to stack the two ink ribbon cassettes 105 on the carriage table 175 horizontally. Pins 175*a* and 175*b* and hooks 175*c*, 175*d*, and 175*e* are formed on the upper surface of the carriage table 175.

When the ink ribbon cassette 105 is loaded in the lower position, the pins 175*a* and 175*b* are inserted into openings 120 and 121 formed in the upper and lower cases of the ink ribbon cassette 105 (FIGS. 29 and 30) to be described in detail later. The hook 175*c* is elastically engaged with a lock portion 131 of the lower case, and the ink ribbon cassette 105 is detachably loaded on the carriage table 175. A similar operation is performed to load the ink ribbon cassette 105 at the upper position. The pins 175*a* and 175*b* are inserted into the openings 120 and 121, and the hooks 175*d* and 175*e* are elastically engaged with engaging portions 130 and 132 of the lower case, thereby loading the upper ink ribbon cassette 105 on the carriage table 175 through the lower ink ribbon cassette 105.

A plurality (two stages) of ink sheet (including the ink ribbon) loading sections are formed.

The ink sheet cassette (including the ink ribbon) will be described with reference to FIG. 29 (perspective view) and FIG. 30 (plan view).

Figure 29:
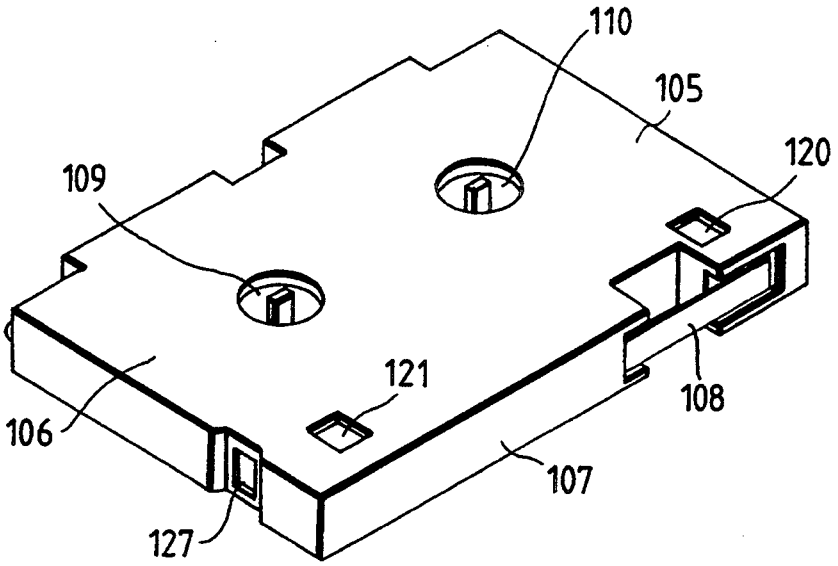
FIG. 29 is a perspective view showing an outer appearance of a multi-color ink ribbon cassette.
Figure 30:
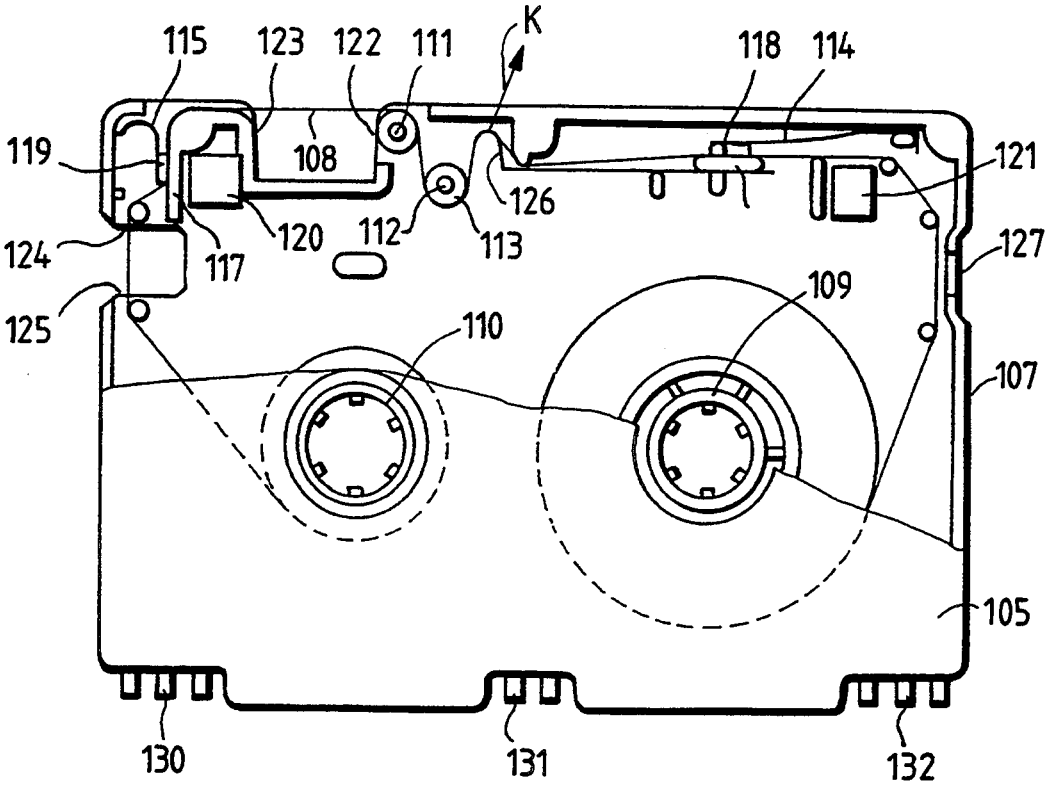
FIG. 30 is a plan view showing a structure of the multi-color ink ribbon cassette.

Referring to FIGS. 29 and 30, the ink ribbon cassette 105 includes an upper case 106 and a lower case 107. The ink ribbon cassette 105 is detachably loaded on the carriage table 175 while storing an ink ribbon 108 therein.

The ink ribbon 108 is wound around a supply core 109 and is guided outside the cassette 105 through an opening 122 of the lower case via rollers 113 rotatably mounted on projection portions 111 and 112 of the lower case 107. The ink ribbon 108 enters into the cassette 105 again from an opening 123 of the lower case and is then exposed outside the cassette 105 through an opening 124 of the lower case. The ink ribbon 108 then enters into the cassette 105 through an opening 125 of the lower case and is then wound around a winding core 110.

When the cassette 105 is loaded on the carriage table 175 at a predetermined position, the ink ribbon 108 exposed from the openings 122 and 123 of the cassette 105 at positions opposite to the head 176 of the main body. The exposed portions of the ink ribbon 108 can be heated by the thermal head 176 heated in accordance with the recording information. The ink ribbon 108 is biased against projection portions 116 and 117 of the lower case 107 by compression springs 114 and 115 arranged in the lower case 107. Felt members 118 and 119 are adhered to the compression springs 114 and 115, respectively, to prevent damage to the ink ribbon 108 upon contact.

A tension spring 126 biases the ink ribbon 108 in a direction of an arrow K and incorporates with the compression springs 114 and 115 to eliminate slackening of the ink ribbon 108.

Part of the ink ribbon 108 is exposed from an opening 127 of the lower case 107. When the cassette 105 is loaded on the carriage table 175 at a predetermined position, a ribbon sensor S2 (FIG. 31) is located at a predetermined position of the carriage table 175 and detects a ribbon end of the ink ribbon 108. The color sensor S3 opposes the ink ribbon 108 exposed from the openings 124 and 125 of the lower case 107 to detect the bar codes of the ink ribbon 108 which pass by the sensor S3.

Figure 32:
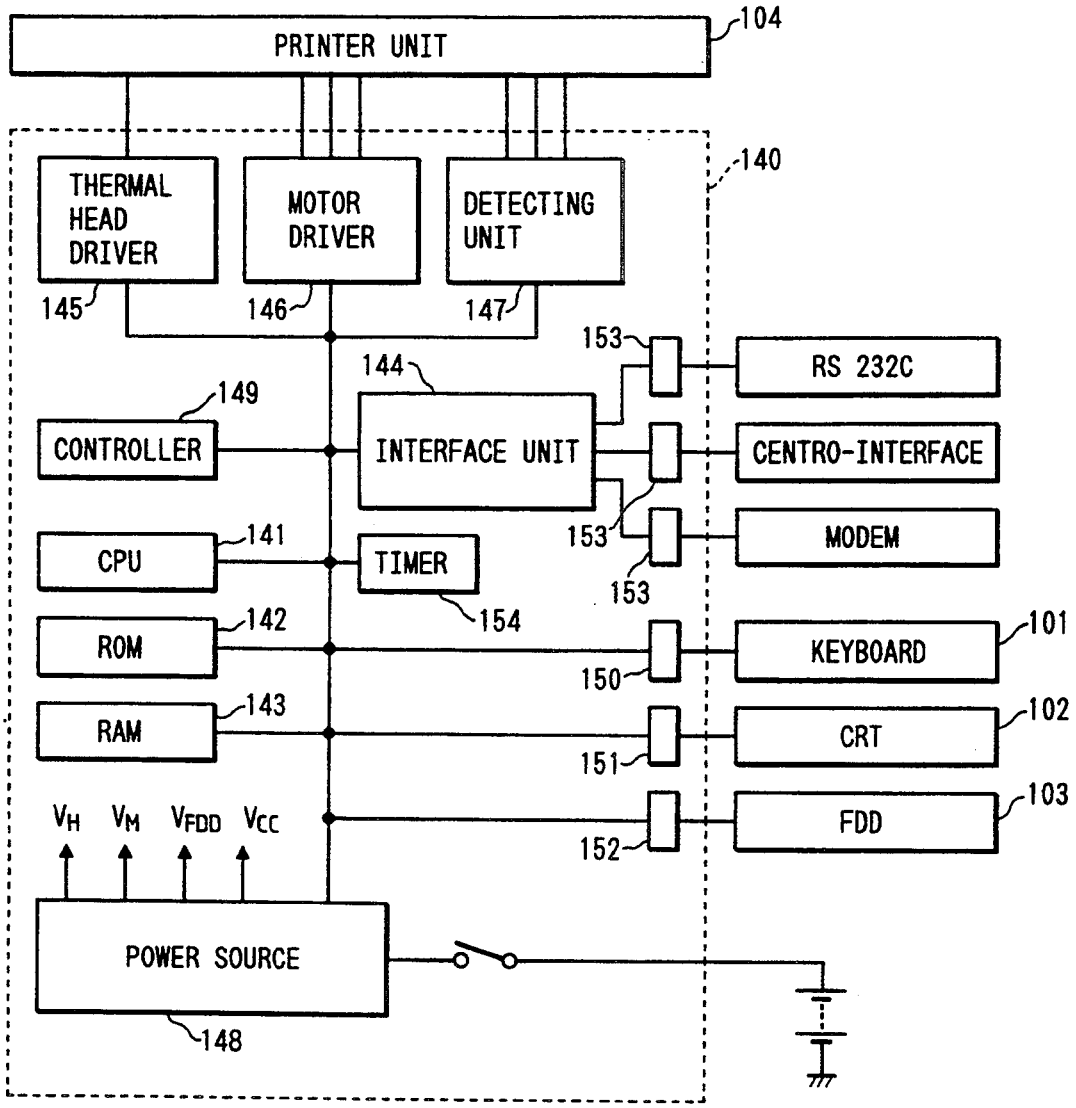
FIG. 32 is a block diagram showing an arrangement of the recording apparatus of the embodiment shown in FIG. 26.

FIG. 32 is a block diagram showing an arrangement of the image recording apparatus described above.

Referring to FIG. 32, a CPU 141 is a central processing unit for reading out programs and various data from a ROM 142 and a floppy disk FDD103 (both of which will be described in detail later), performs necessary arithmetic operations and determination, and performs various control operations. The CPU 141 may be constituted by a plurality of units. The ROM 142 is a read-only memory for storing various programs for operating the CPU 141, character codes, dot patterns (character generator: CG), and various data necessary for printing. A RAM 143 is a read/write memory which consists of a working area for temporarily storing instruction data and arithmetic results, a buffer area for storing various data input from an interface unit 144, a keyboard 101, or the floppy disk FDD103, and a text area for storing a document.

The CPU unit 140 is connected to a thermal head driver 145, a motor driver 146, and a printer unit 104 through detectors 147 serving as a detecting unit consisting of a thermistor and various other sensors.

The thermal head driver 145 drives the thermal head 116 arranged in the printer unit 104 under the control of the CPU 141. The motor driver 146 drives the sheet feed motor M1 and the carriage motor M2 under the control of the CPU 140. The detecting unit 147 detects measurement results from a thermistor S1, a paper sensor (not shown) arranged in the printer unit 104, a ribbon sensor (not shown), and the like.

A power source 148 supplies a drive power source VH for the thermal head 116, a drive power source VM for the paper feed motor M1 and the carriage motor M2, a drive power source VFDD for the floppy disk FDD103, and a power source VCC for other logic circuits.

A controller 149 transfers printing data to the thermal head 116, changes the voltage/current of the power source VH, changes a heating time and a duty ratio, and performs any other control operation under the control of the CPU 141. The keyboard 101 is connected to the CPU unit 140 to input various data necessary for printing and editing through a keyboard connector 150. A CRT 102 is also connected to the CPU unit 141 to display data input from the keyboard 101 through a CRT connector 151 and various data. Another display unit such as a liquid crystal display unit may be used in place of the CRT 102. The floppy disk FDD103 is connected to the CPU unit 141 through a FDD connector 152. A hard disk, an external RAM, an external ROM, or the like can be connected in place of the floppy disk FDD103.

An interface such as RS232C, a CENTRO-interface, or a modem can be connected to the CPU unit to control the recording apparatus by an external controller through an interface connector 153 and to perform communication with an external device. A timer 154 measure time in accordance with an instruction from the CPU 141. In this embodiment, the timer 154 measures the ON and OFF times of the bar codes.

Figures 33, 33A:
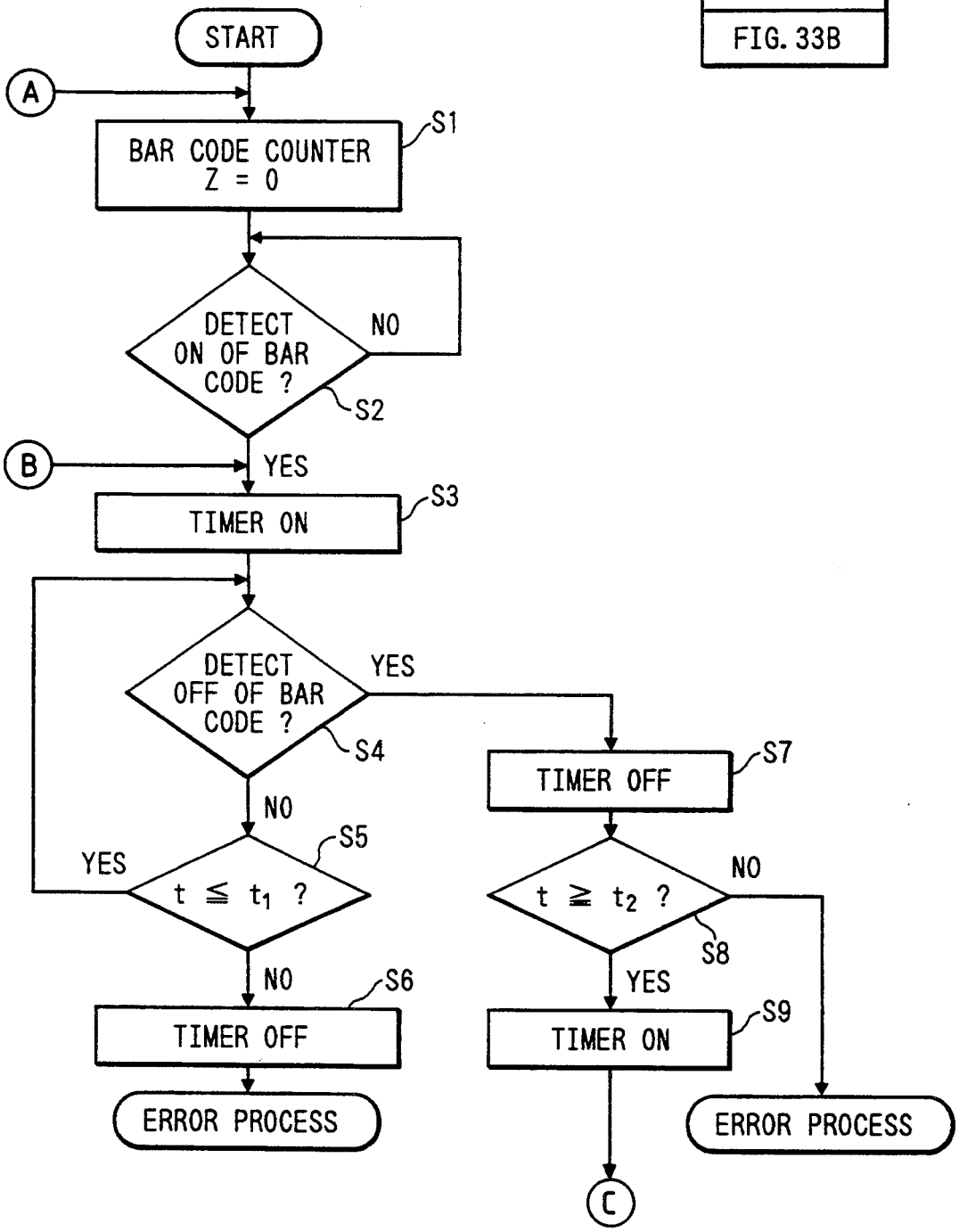
FIG. 33 shows the relationship between the flow charts of FIGS. 33A and 33B.
FIGS. 33A and 33B are flow charts showing a sequence of the embodiment shown in FIG. 26.
Figure 33B:
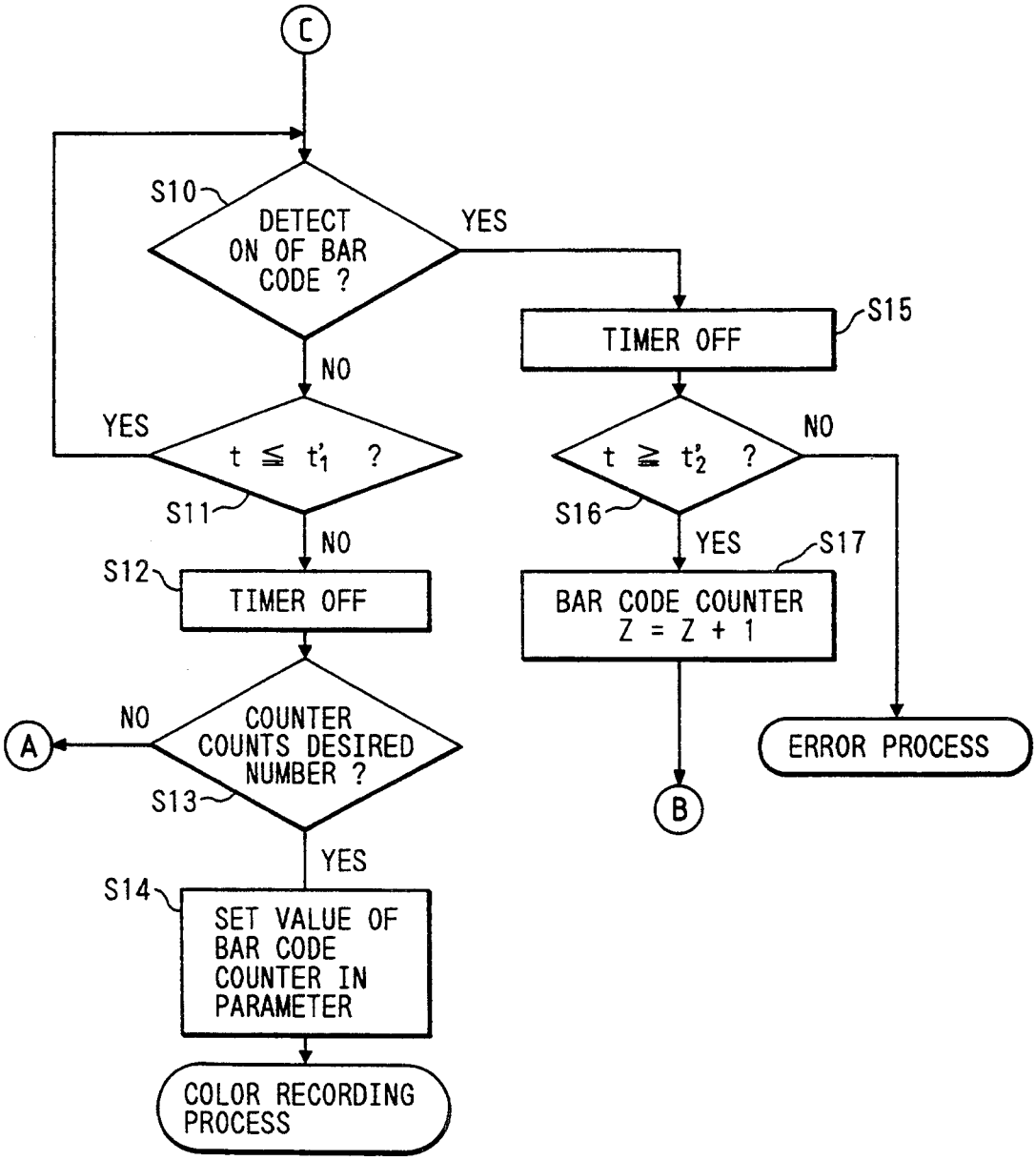

Bar code detection processing of this embodiment will be described with reference to a flow chart in FIG. 33.

In step S1, a counter Z for counting the number of bar codes is cleared to "0". In step S2, the CPU 141 waits until the color sensor of the detecting unit 147 detects a bar code OFF state while ink ribbon winding operation continues. When the bar code ON state is detected, the flow advances to step S3, and the CPU 141 causes the timer 154 to start to measure the ON time. In step S4, detection of the OFF time within the maximum time t1 of the bar code is waited. If this timing is detected, the flow advances to step S7 to read out a value of the timer 154, and the CPU 141 outputs a stop instruction. However, if NO in step S4, the flow advances to step S5 to check whether the value of the timer 154 satisfies the bar code maximum time t1. If NO in step S5, the flow advances to step S6 to stop the timer 154, and error processing is executed. If the value is smaller than the value corresponding to the bar code maximum time t1 in step S5, the flow returns to step S4, and OFF detection of the bar code continues.

When the flow advances from step S4 to step S7, the CPU 141 checks in step S8 whether the value of the timer 154 satisfies the bar code minimum time t2. If NO in step S8, error processing is executed. However, if YES in step S8, the flow advances to step S9 to start the timer 154 to measure the OFF time of the bar code. The CPU 141 waits for detection of the ON state of the bar code within the maximum interval t1' in step S10. When this detection is determined, the flow advances to step S15. However, if NO in step S10 i.e., if the OFF state is determined, the CPU 141 checks in step S11 whether the value of the timer 154 exceeds the interval t1'. If YES in step S11, i.e., when the next bar code is not present, the flow advances to step S12 to stop the timer 154. The CPU 141 checks in step S13 whether a bar code corresponding to a desired color is detected in accordance with the value of the counter Z. If the detected bar code does not represent a desired color, the flow returns to step S1, and detection continues. However, if YES in step S13, the flow advances to step S14, and color recording is performed by using the counter value as a parameter.

When the next ON state is detected within the interval t1' in step S10, the timer 154 is stopped in step S15. In step S16, the CPU 141 checks whether the OFF time of the detected bar code exceeds the minimum interval t2'. If NO in step S16, error processing is performed. However, if YES in step S16, the flow advances to step S17 to increment the counter Z for counting the number of bar codes. The flow then returns to step S3. The above operations are repeated. When detection of the succeeding bar codes is completed, color recording can be performed with a desired color.

Figure 34:
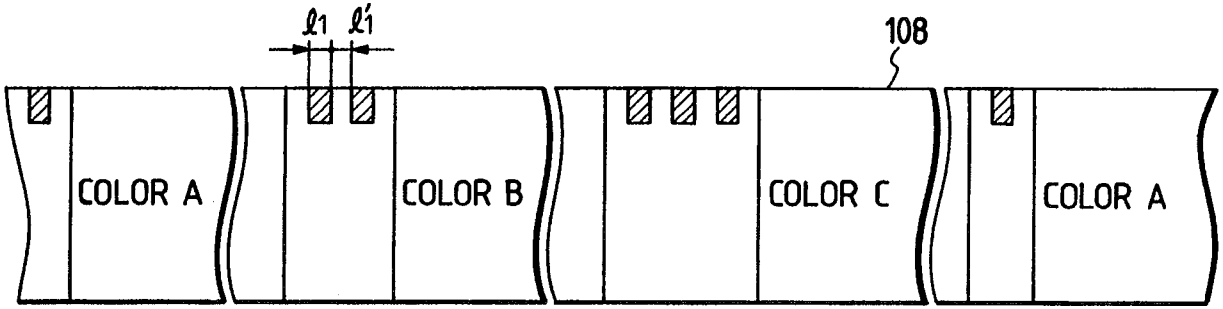
FIG. 34 is a view showing a modification of the embodiment shown in FIG. 26.

This embodiment exemplifies printing using a multi-color ink ribbon. However, the same effect as described above can be obtained by using an ink sheet for a line printer, as shown in FIG. 34. Bar codes are the same as those in an ink ribbon for a serial printer.

Figure 35:
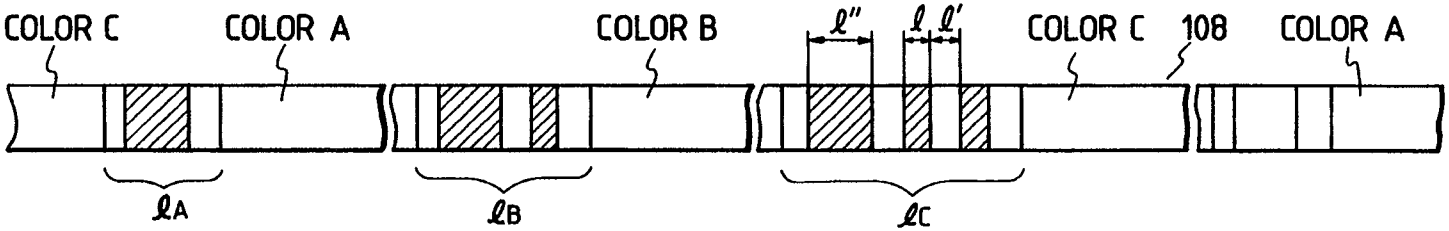
FIG. 35 is a view showing bar codes according to still another embodiment of the present invention.

FIG. 35 is a plan view of a multi-color ink ribbon according to still another embodiment of the present invention. In this embodiment, a width l'' of the first bar code is set to be detected even if the diameter of the ribbon is a diameter at the start or end of ribbon winding.

Figure 36A:
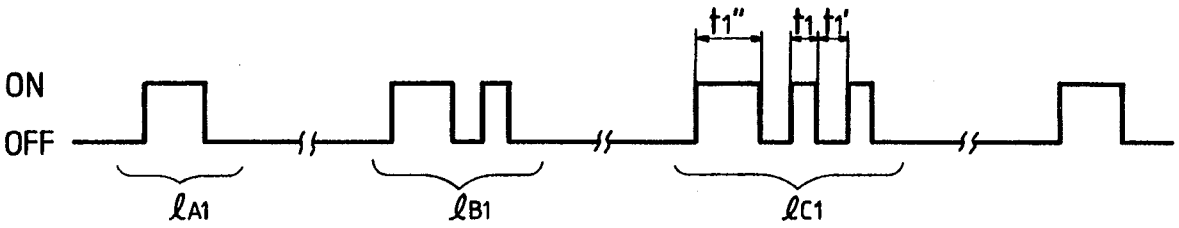
FIGS. 36A and 36B are views showing timings of a color sensor shown in FIG. 35.
Figure 36B:
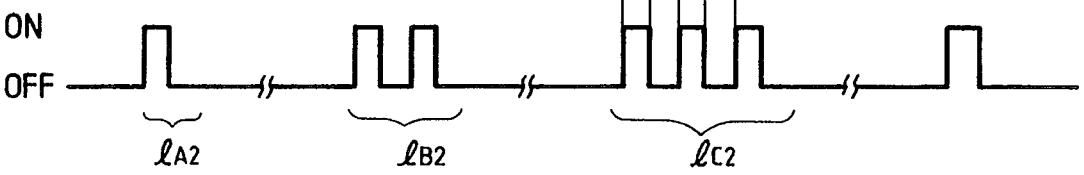
Figure 38:
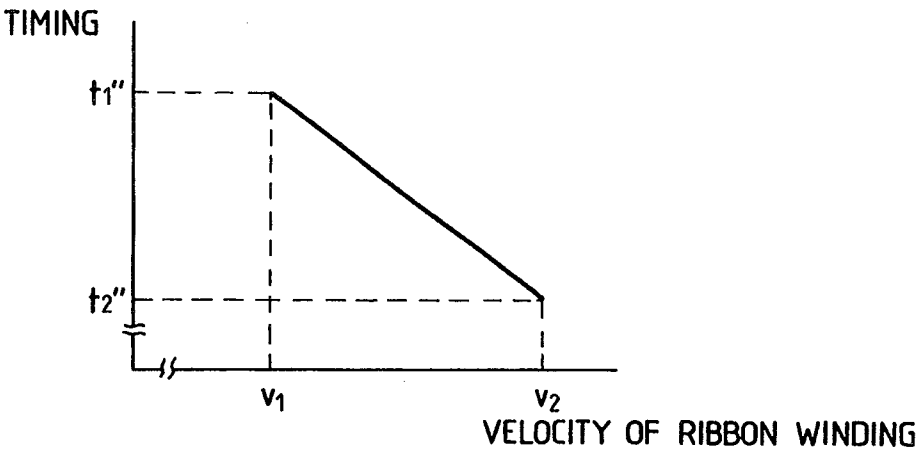
FIG. 38 is a view showing a relationship between a winding velocity and a detection timing.

FIGS. 36A is a timing chart showing the ON and OFF timings of the color sensor at the start of ribbon winding, and FIG. 36B is a timing chart showing the ON and OFF timings of the color sensor at the end of ribbon winding.

Figure 37:
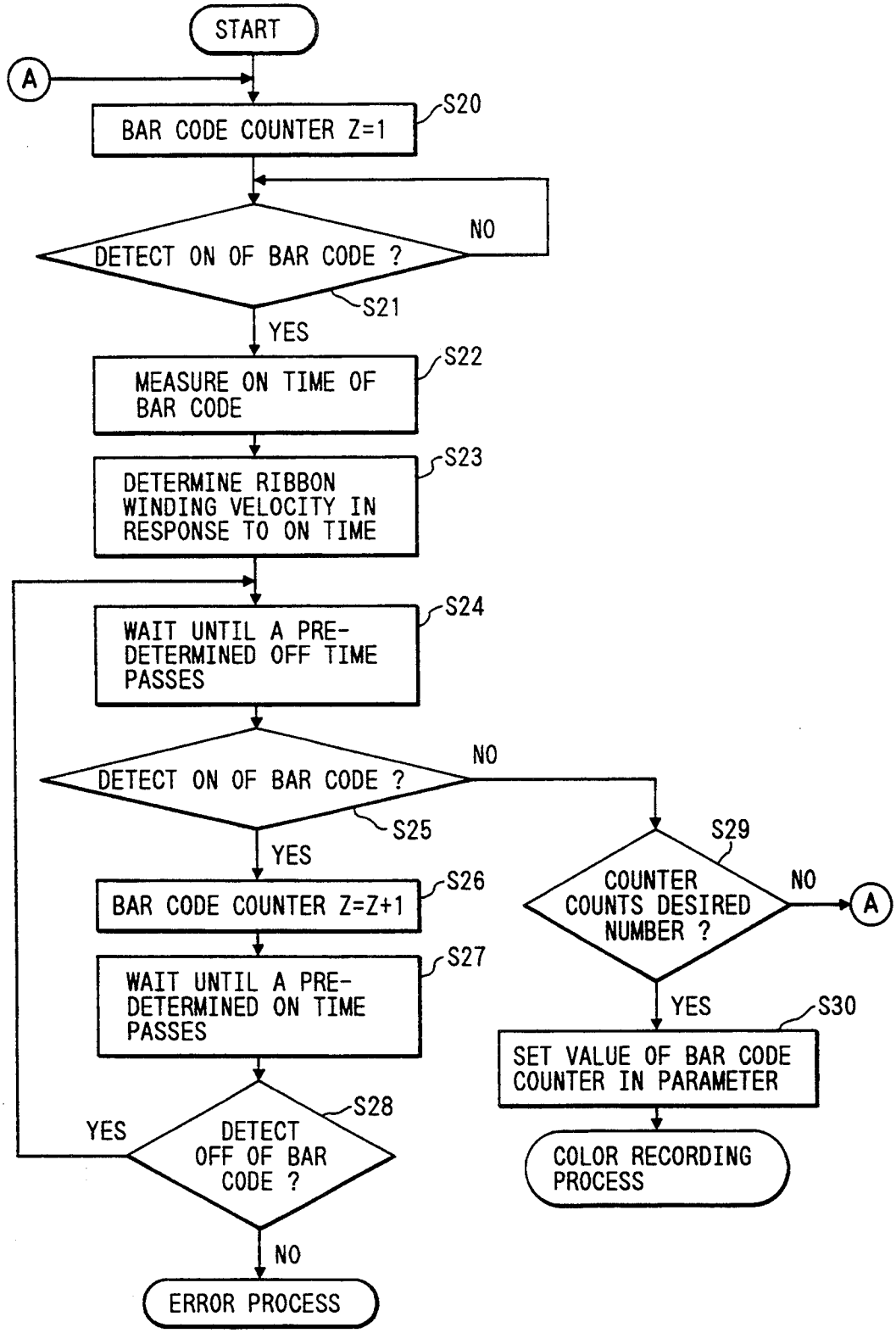
FIG. 37 is a flow chart showing a sequence according to the embodiment shown in FIG. 35.

FIG. 37 is a flow chart showing a sequence of this embodiment.

In step S20, "1" is set in a counter Z for counting the number of bar codes. In step S21, the bar code ON state by ink ribbon winding is detected in step S21. When the ON state is detected, the flow advances to step S22 to measure the ON time (timing) of the bar code. This operation is to measure a duration from time when the timer is set to time when the OFF time is detected. In step S23, a ribbon winding velocity is determined on the basis of the measured bar code 0N time.

The bar code ON time at the start of ribbon winding is different from that at its end. When the ribbon winding velocity is determined based on the ON time (timing) of the bar code shown in FIG. 13, the ON time from the second bar codes can be maintained constant regardless of the ribbon winding diameter.

The CPU 141 waits until the bar code OFF time (predetermined period of time) has elapsed in step S24. The CPU 141 checks in step S25 whether the bar code 0N times are continuously detected. In this case, when the bar code region is ended, the flow advances to step S29. However, the bar code area still continues, the counter for counting the number of bar codes is incremented in step S26. The CPU 141 waits until the bar code ON time (predetermined period of time) has elapsed in step S27. When this ON time has elapsed, the CPU 141 determines in step S28 whether the bar code OFF time is detected. However, if NO in step S28, error processing is executed. Otherwise, the flow returns to step S24, and OFF detection continues.

If NO in step S25, the CPU 141 determines in step S29 whether a desired color is detected based on the count. If the count does not represent the desired color, the flow returns to step S20, and the above operations are repeated. If the count represents the bar code corresponding to the desired color, the flow advances to step S30. Color recording is performed using the count as a parameter.

According to this embodiment, the first ON time is measured, and the ribbon winding velocity is changed based on this measured ON time. The ON times from the subsequent bar codes can be maintained constant.

Since the ON time can be maintained constant, the width of the bar code can be narrowed, and the maximum recoding range of the cassette can be increased.

According to the present invention as described above, bar code detection errors can be eliminated, and color detection errors for the multi-color ink sheet can be eliminated.

According to the present invention as has been described above in detail, color switching can be accurately and quickly performed.

What is claimed is:

1. An image recording apparatus for recording an image on a recording medium by using ink contained in an ink member, said apparatus comprising:

a recording head acting on the ink member to record the image on the recording medium;

a drive source;

a mounting section for mounting a plurality of ink members;

discriminating means for discriminating whether ink of an ink member mounted on said mounting section is of mono color or plural colors;

first driving force transmitting means for transmitting a driving force from said drive source through a load absorbing mechanism to the mounted ink member to convey the mounted ink member;

second driving force transmitting means for transmitting the driving force from said drive source by bypassing the load absorbing mechanism to the mounted ink member to convey the mounted ink member;

shift means for shifting said recording head between a recording position where said recording head records and a retracted position retracted from the recording position; and selection means for selecting said first driving force transmitting means to convey the mounted ink member when said recording head is at the recording position to record and selecting said second driving force transmitting means to convey the mounted ink member when said recording head is at the retracted position and said discriminating means discriminates that the ink of the mounted ink member is of plural colors and the color of ink with which recording is to be effected is to be changed.

2. An apparatus according to claim 1, wherein said second driving force transmitting means is for feeding the ink member, by bypassing said load absorbing mechanism, at an ink driving force transmitting means, which is for member feed velocity higher than that of said first feeding the ink member through said load absorbing mechanism.

3. An image recording apparatus for recording an image on a recording medium by using ink contained in an ink member, said apparatus comprising:

a platen;

a recording head acting on the ink member to record the image on the recording medium;

a mounting section for mounting a plurality of said ink members;

discrimination means for discriminating whether ink of an ink member mounted on said mounting section is of mono color or plural colors;

shifting means for shifting said recording head between a press position where said recording head is pressed to said platen with the mounted ink member and said recording medium therebetween and a retracted position retracted from the press position;

first driving force transmitting means for winding the mounted ink member through a load absorbing mechanism in accordance with movement of said recording head along the recording medium for recording;

second driving force transmitting means for winding the mounted ink member by bypassing said load absorbing mechanism in accordance with movement of said recording head along the recording medium for recording; and selection means for selecting said first driving force transmitting means to convey the mounted ink member when said recording head is at the press position to record and selecting said second driving force transmitting means to convey the mounted ink member when said recording head is at the retracted position and the color of ink with which recording is to be effected is to be changed, said selection means disconnects the drive force transmission from said first and second driving force transmitting means when said recording head is at the retracted position and a recording standby state is set.

4. An apparatus according to claim 3, wherein said second driving force transmitting means is for feeding the ink member, by bypassing said load absorbing mechanism, at an ink member feed velocity higher than that of said first driving force transmitting means which is for feeding the ink member through said load absorbing mechanism.

5. An image recording method for recording an image on a recording medium, said method comprising the steps of:

providing a recording head that records with ink of an ink member containing the ink, the ink member being mounted on a mounting section capable of mounting a plurality of the ink members, a first drive force transmitting member for transmitting a drive force from a drive source through a load absorbing mechanism to the ink member, and a second drive force transmitting member for transmitting the drive force from the drive source by bypassing the load absorbing mechanism to the ink member;

discriminating whether the ink of the ink member is a single color or plural colors; and selecting one of conveyance of the ink member by the first drive force transmitting member when the recording head is at a recording position and records and conveyance of the ink member by the second drive force transmitting member when it is discriminated in said discriminating step that the ink of the ink member is of plural colors and when the recording head is at a retracted position and the color of the ink member is to be changed.

6. A method according to claim 5, wherein in said selecting step an ink member feed velocity of the second driving force transmitting mechanism for feeding the ink member by bypassing the load absorbing mechanism is higher than that of the first driving force transmitting mechanism for feeding the ink member through the load absorbing mechanism.

7. An image recording method for recording an image on a recording medium, said method comprising the steps of:

providing a recording head that records with ink of an ink member containing the ink, the ink member being mounted on a mounting section capable of mounting a plurality of the ink members, a first drive force transmitting member for winding the ink member through a load absorbing mechanism in response to movement of the recording head along the recording medium for recording, and a second drive force transmitting member for winding the ink member by bypassing the load absorbing mechanism in response to movement of the recording head along the recording medium for recording;

discriminating whether the ink of the ink member is a single color or plural colors; and selecting one of conveyance of the ink member by the first drive force transmitting member when the recording head is at a pressing position and records and conveyance of the ink member by the second drive force transmitting member when the recording head is at a retracted position and the color ink of the ink member is to be changed, wherein transmission from the first and second transmitting mechanisms is disconnected when the recording head is at the retracted position and in a standby state.

8. A method according to claim 7, wherein in said selecting step an ink member feed velocity of the second driving force transmitting mechanism for feeding the ink member by bypassing the load absorbing mechanism is higher than that of the first driving force transmitting mechanism for feeding the ink member through the load absorbing mechanism.

9. A method for recording utilizing an ink member provided with a plurality of colors of ink at a predetermined periodic interval, said method comprising the steps of:

providing a recording head movable between a recording position and a retracted position for recording using the ink member when in the recording position, a first drive force transmitting member for transmitting a drive force from a drive source through a load absorbing mechanism to the ink member, and a second drive force transmitting member for transmitting the drive force from the drive source to the ink member by bypassing the load absorbing mechanism;

selecting the first drive force transmitting member when the recording head is at the recording position and selecting the second drive force transmitting member when the recording head is at the retracted position; and detecting a border section of the ink member between a first color and a second color different from the first color when the recording head is at the retracted position.

10. A method according to claim 9, wherein in said selecting step an ink member feed velocity of the second driving force transmitting mechanism for feeding the ink member by bypassing the load absorbing mechanism is higher than that of the first driving force transmitting mechanism for feeding the ink member through the load absorbing mechanism.

11. A method according to claim 9 wherein in said detecting step, a bar code in the border section is detected.

* * * * *

UNITED STATES PATENT AND TRADEMARK OFFICE

CERTIFICATE OF CORRECTION

PATENT NO. : 5,383,734

DATED : January 24, 1995

INVENTOR(S) : YOSHIO UCHIKATA, ET AL.

It is certified that error appears in the above-indentified patent and that said Letters Patent is hereby corrected as shown below:

COLUMN 1:

Line 13, "Filed" should read --Field--.

COLUMN 2:

Line 52, "according" should read --according to--.

COLUMN 6:

Line 49, "14a." should read --14.--.

COLUMN 7:

Line 5, "C1)." should read --C1)--.

COLUMN 19:

Line 5, "Carriage" should read --carriage--.

Line 34, "fining" should read --finding--.

UNITED STATES PATENT AND TRADEMARK OFFICE

CERTIFICATE OF CORRECTION

PATENT NO. : 5,383,734

DATED : January 24, 1995

INVENTOR(S) : YOSHIO UCHIKATA, ET AL.

It is certified that error appears in the above-indentified patent and that said Letters Patent is hereby corrected as shown below:

COLUMN 24:

Line 58, "measure" should read --measures--.

COLUMN 26:

Line 6, "0N" should read --ON--.

Line 16, "0N" should read --ON--.

Line 61, "mono color" should read --mono-color--.

COLUMN 27:

Line 20, "ink driving" should read --ink member feed velocity higher than that of said first driving--.

Line 21, "member feed velocity higher than that of said first" should be deleted.

Line 35, "mono color" should read --mono-color--.

UNITED STATES PATENT AND TRADEMARK OFFICE

CERTIFICATE OF CORRECTION

PATENT NO. : 5,383,734 Page 3 of 3

DATED : January 24, 1995

INVENTOR(S) : YOSHIO UCHIKATA, ET AL.

It is certified that error appears in the above-indentified patent and that said Letters Patent is hereby corrected as shown below:

COLUMN 30:

Line 15, "claim 9" should read --claim 9,--.

IN THE DRAWINGS:

SHEET 18:

Fig. 23, "MULTI RIBBON" should read --MULTI-RIBBON--.

Signed and Sealed this

Second Day of May, 1995

*Attest:*

Bruce Lehman

BRUCE LEHMAN

*Attesting Officer*

*Commissioner of Patents and Trademarks*